US006794356B2

(12) United States Patent
Turner et al.

(10) Patent No.: US 6,794,356 B2
(45) Date of Patent: Sep. 21, 2004

(54) FABRIC SOFTENING COMPOSITION COMPRISING A MALODOR CONTROLLING AGENT

(75) Inventors: John Christopher Turner, Overijse (BE); Hugo Jean Marie Demeyere, Merchtem (BE); Hans Wendt, Brussels (BE); Amelita Gonzales Mirasol, Kobe (JP); Johannson Jimmy Tee, West Chester, OH (US); Francis Cornelio Ford, Cincinnati, OH (US); Francisco Go Lao, Jr., Mason, OH (US); Gong-Xiang Chen, Mikagenaka-machi (JP); Mathieu Angela Willy Steenland, Dilbeek (BE); Muriel Leila Gisele Cordier, Brussels (BE); Sumitra Pasupathy, London (GB); Jan Dominiek Verbrugge, Oelegem (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/268,436

(22) Filed: Oct. 10, 2002

(65) Prior Publication Data

US 2003/0139313 A1 Jul. 24, 2003

Related U.S. Application Data

(63) Continuation of application No. PCT/US01/16357, filed on May 18, 2001.
(60) Provisional application No. 60/206,752, filed on May 24, 2000.

(51) Int. Cl.[7] ..... C11D 3/22
(52) U.S. Cl. ..... 510/516
(58) Field of Search ..... 510/516

(56) References Cited

U.S. PATENT DOCUMENTS

| | | | | | |
|---|---|---|---|---|---|
| 5,234,611 | A | | 8/1993 | Trinh et al. | |
| 5,681,806 | A | | 10/1997 | Trinh et al. | |
| 5,714,137 | A | * | 2/1998 | Trinh et al. | 424/76.4 |
| 5,747,443 | A | * | 5/1998 | Wahl et al. | 510/515 |
| 5,804,547 | A | * | 9/1998 | Godfroid et al. | 510/499 |

FOREIGN PATENT DOCUMENTS

| | | |
|---|---|---|
| EP | 0 803 498 A1 | 10/1997 |
| JP | 2544362 | 7/1988 |
| WO | WO 98/13456 | 4/1998 |
| WO | WO 99/15611 | 4/1999 |
| WO | WO 99/27050 | 6/1999 |
| WO | WO 00/11134 | 3/2000 |
| WO | WO 00/24851 | 5/2000 |

* cited by examiner

*Primary Examiner*—John R. Hardee
(74) *Attorney, Agent, or Firm*—Mark A. Charles; Jason J. Camp; Brahm J. Corstanja

(57) ABSTRACT

A fabric softening composition including from about 1% to about 90% by weight of a fabric softening active, optionally from about 1% to about 25% by weight of a principal solvent having a ClogP of less than about 3, from about 0.05% to about 15% by weight of a malodor controlling agent, and the balance being adjunct ingredients. The malodor controlling agent is selected from the group consisting of a quaternary ammonium antimicrobial agent, cyclodextrin or mixtures of these ingredients. The present invention also relates to a method for reducing malodor by applying such a composition to a fabric article, and drying the fabric article as well as the use of such a composition on fabric articles to reduce malodor impression. An article for reducing and inhibiting the expression of malodor impression is also provided.

16 Claims, No Drawings

FABRIC SOFTENING COMPOSITION COMPRISING A MALODOR CONTROLLING AGENT

CROSS REFERENCE TO RELATED APPLICATIONS

This is a continuation of International Application No. PCT/US01/16357, with an International Filing Date of May 18, 2001, which claims benefit of Provisional Application Serial No. 60/206,752 filed on May 24, 2000.

FIELD OF THE INVENTION

The present invention relates to a softening composition. Specifically, the present invention relates to a fabric softening composition for preventing and/or inhibiting the expression of malodor on fabrics.

BACKGROUND OF THE INVENTION

Microorganisms can grow on a fabric article during drying, storing and wearing. Some of these microorganisms are highly infectious and may increase the health risks to the consumer, while others, especially bacteria such as *S. aureus,* can generate malodor. Microorganism accumulation and/or malodor generation are particularly acute for clothing items such as underwear and socks due to the favorable environment for bacterial growth (e.g., high humidity and easily-available nutrition sources). Another situation which may generate malodors is when fabrics are dried indoors. Malodor generation and accumulation during drying is especially prevalent during drying indoors because the high humidity indoors is a favorable environment for bacterial growth.

It is known to control the germ growth on fabrics, for example, by injecting antimicrobial compounds into fabrics during the weaving process to prepare antibacterial fabrics. However, the antibacterial compound may be easily washed away after multiple laundering processes, or the compound may become inactivated over time.

Further, malodors may occur in fabrics for reasons other than bacterial growth and as such, there are a large number of malodors that are deposited or absorbed onto fabrics during wear that are unaffected by the presence of an antimicrobial agent. These other malodors may include body odors, smoke, and greasy odors among others. Historically, the development of new fabric softeners has focused solely on masking or covering these malodor(s) with a perfume and few efforts have focused on preventing the occurrence or expression of these malodors. For instance, U.S. Pat. No. 5,234,611, Trinh et al., issued Aug. 10, 1993, relates to a fabric softening composition containing dryer-activated cyclodextrin-perfume complexes for effectively depositing a perfume on the fabrics.

Accordingly, the need exists for an improved fabric softening composition that prevents and/or inhibits the expression of malodors that are created in or absorbed by fabrics while the fabric article is being worn and more generally, between launderings. Furthermore, the need exists for a method of preventing and/or inhibiting the expression of malodor in such articles.

SUMMARY OF THE INVENTION

The present invention relates to a clear, concentrated stable fabric softening composition comprising from about 1% to about 90% by weight of a fabric softening active; and from about 0.01% to about 20% by weight of a malodor controlling agent comprising a cyclodextrin. The present invention also relates to a method for preventing malodor and for preventing and/or inhibiting malodor by applying such a composition to a fabric article, and drying the fabric article.

It has now been found that a fabric softening composition may provide not only a superior softening benefit and a wrinkle-reducing benefit on a fabric article, but may also provide a significant malodor controlling benefit. Furthermore, the malodor controlling benefit is believed to be dispersed throughout the fabric article, e.g., on the fabric fibers themselves, rather than being limited to the surface of the fabric article. Thus, it is believed that the present composition provides significantly improved malodor control, as compared to known antimicrobial fabric softening compositions. It is also believed that the present method may co-deposit the malodor controlling agent with the softening actives during the rinse, so as to provide both a fabric softening effect and long term malodor reduction/prevention benefits. This may be especially true in the case where the malodor controlling agent is a cyclodextrin or mixture containing cyclodextrin that will prevent and/or inhibit the expression of malodor by complexing with malodor that may form or collect amongst the fibers of the article.

In a process aspect of the present invention there is provided a method for reducing and inhibiting the expression of malodors in a fabric article by applying a fabric softening composition according to the present invention and drying the fabric article. The use of the fabric softening compositions of the present invention to reduce and inhibit the expression of malodors in fabric articles is also provided.

The present invention further still provides an article for reducing or inhibiting the expression of malodor in fabric articles, the article comprising a fabric softening composition of the present invention and a set of instructions associated with the composition. The set of instructions comprising an instruction to the consumer to apply the fabric softening compositions of the present invention to their fabric articles to reduce and inhibit the expression of malodor in their fabric articles.

DETAILED DESCRIPTION OF THE INVENTION

All percentages, ratios and proportions herein are by weight, unless otherwise specified. All temperatures are in degrees Celsius (° C.) unless otherwise specified. All documents cited are incorporated herein by reference in their entireties. Citation of any reference is not an admission regarding any determination as to its availability as prior art to the claimed invention.

As used herein, the term "alkyl" means a hydrocarbyl moiety which is straight or branched, saturated or unsaturated. Unless otherwise specified, alkyl moieties are preferably saturated or unsaturated with double bonds, preferably with one or two double bonds. Included in the term "alkyl" is the alkyl portion of acyl groups.

As used herein, "comprising" means that other steps and other ingredients which do not affect the end of result can be added. This term encompasses the terms "consisting of" and "consisting essentially of".

As used herein, the term "fabric article" means any fabric, fabric-containing, or fabric-like item which is laundered, conditioned, or treated on a regular, or irregular basis. Non-limiting examples of a fabric article include clothing, curtains, bed linens, wall hangings, textiles, cloth, etc.

Preferably, the fabric article is a woven article, and more preferably, the fabric article is a woven article such as clothing. Furthermore, the fabric article may be made of natural and artificial materials, such as cotton, nylon, rayon, wool, and silk.

Fabric Softener Actives

Typical levels of incorporation of the softening compound (active) in the softening composition are of from 1% to 90%, preferably from 2% to 70%, and even more preferably from 5% to 40%, by weight of the composition. The fabric softener compound preferably has a phase transition temperature of less than about 55° C. Where a clear fabric softening composition is desired, it is preferred that the fabric softener compound have a phase transition temperature of less than 50° C., more preferably less than about 35° C., even more preferably less than about 20° C., and yet even more preferably less than about 0° C., and preferably is biodegradable as disclosed hereinafter. Likewise, where a clear composition is desired, the IV is preferably from about 40 to about 140, preferably from about 50 to about 120 and even more preferably from about 85 to about 105. When an unclear composition is desired, the IV may be below 40.

The softening compounds can be selected from cationic, nonionic, and/or amphoteric compounds. Typical of the cationic softening compounds are the quaternary ammonium compounds or amine precursors thereof as defined hereinafter.

Preferred Diester Quaternary Ammonium Fabric Softening Active Compound (DEQA)

(1) The first type of DEQA preferably comprises, as the principal active, [DEQA (1)] compounds of the formula $$\{R_{4-m}—N^+—[(CH_2)_n—Y—R^1]_m\}X^-$$

wherein each R substituent is either hydrogen, a short chain $C_1$-$C_6$, preferably $C_1$–$C_3$ alkyl or hydroxyalkyl group, e.g., methyl (most preferred), ethyl, propyl, hydroxyethyl, and the like, poly ($C_{2-3}$ alkoxy), preferably polyethoxy, group, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group, and $X^-$ can be any softener-compatible anion, preferably, chloride, bromide, methylsulfate, ethylsulfate, sulfate, and nitrate, more preferably chloride or methyl sulfate (As used herein, the "percent of softener active" containing a given $R^1$ group is based upon taking a percentage of the total active based upon the percentage that the given $R^1$ group is, of the total $R^1$ groups present.);

(2) A second type of DEQA active [DEQA (2)] has the general formula:

$$[R_3N^+CH_2CH(YR^1)(CH_2YR^1)]X^-$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]Cl^{(-)}$$

wherein each R is a methyl or ethyl group and preferably each $R^1$ is in the range of $C_{15}$ to $C_{19}$. As used herein, when the diester is specified, it can include the monoester that is present. The amount of monoester that can be present is the same as in DEQA (1).

These types of agents and general methods of making them are disclosed in U.S. Pat. No. 4,137,180, Naik et al., issued Jan. 30, 1979, which is incorporated herein by reference. An example of a preferred DEQA (2) is the "propyl" ester quaternary ammonium fabric softener active having the formula 1,2-di(acyloxy)-3-trimethylammoniopropane chloride, where the acyl is the same as that of $FA^1$ disclosed hereinafter.

Some preferred clear fabric softening compositions of the present invention contain as an essential component from about 2% to about 75%, preferably from about 8% to about 70%, more preferably from about 13% to about 65%, and even more preferably from about 18% to about 45% by weight of the composition, of softener active having the formula:

$$[R^1C(O)OC_2H_4]_mN^+(R)_{4-m}X^-$$

wherein each $R^1$ in a compound is a $C_6$–$C_{22}$ hydrocarbyl group, preferably having an IV from about 70 to about 140 based upon the IV of the equivalent fatty acid with the cis/trans ratio preferably being as described hereinafter, m is a number from 1 to 3 on the weight average in any mixture of compounds, each R in a compound is a $C_{1-3}$ alkyl or hydroxy alkyl group, the total of m and the number of R groups that are hydroxyethyl groups equaling 3, and X is a softener compatible anion, preferably methyl sulfate. Preferably the cis:trans isomer ratio of the fatty acid (of the C18:1 component) is at least about 1:1, preferably about 2:1, more preferably about 3:1, and even more preferably about 4:1, or higher.

These preferred compounds, or mixtures of compounds, have (a) either a Hunter "L" transmission of at least about 85, typically from about 85 to about 95, preferably from about 90 to about 95, more preferably above about 95, if possible, (b) only low, relatively non-detectable levels, at the conditions of use, of odorous compounds selected from the group consisting of: isopropyl acetate; 2,2'-ethylidenebis (oxy)bis-propane; 1,3,5-trioxane; and/or short chain fatty acid (4–12, especially 6–10, carbon atoms) esters, especially methyl esters; or (c) preferably, both.

The Hunter L transmission is measured by (1) mixing the softener active with solvent at a level of about 10% of active, to assure clarity, the preferred solvent being ethoxylated (one mole EO) 2,2,4-trimethyl-1,3-pentanediol and (2) measuring the L color value against distilled water with a Hunter ColorQUEST® colorimeter made by Hunter Associates Laboratory, Reston, Va.

The level of odorant is defined by measuring the level of odorant in a headspace over a sample of the softener active (about 92% active). Chromatograms are generated using about 200 mL of head space sample over about 2.0 grams of sample. The head space sample is trapped on to a solid absorbent and thermally desorbed onto a column directly via cryofocussing at about −100° C. The identifications of materials is based on the peaks in the chromatograms. Some impurities identified are related to the solvent used in the quaternization process, (e.g., ethanol and isopropanol). The ethoxy and methoxy ethers are typically sweet in odor. There are $C_6$–$C_8$ methyl esters found in a typical current commercial sample, but not in the typical softener actives of this invention. These esters contribute to the perceived poorer odor of the current commercial samples. The level of each odorant in ng/L found in the head space over a preferred active is as follows: Isopropyl acetate—<1; 1,3,5-trioxane—5; 2,2'-ethylidenebis(oxy)-bispropane—<1; $C_6$ methyl ester—<1; $C_8$ Methyl ester—<1; and $C_{10}$ Methyl ester—<1. odorant The acceptable level of each odorant is as follows: isopropyl acetate should be less than about 5, preferably less than about 3, and more preferably less than about 2, nanograms per liter (ηg/L.); 2,2'-ethylidenebis(oxy)bis-propane should be less than about 200, preferably less than about 100, more preferably less than about 10, and even more preferably less than about 5, nanograms per liter (ηg/L.); 1,3,5-trioxane should be less than about 50, preferably less than about 20, more preferably less than about 10, and even more preferably less than about 7, nanograms per liter (ηg/L.); and/or each short chain fatty acid (4–12, especially 6–10, carbon atoms) ester, especially methyl esters should be less than about 4, preferably less than about 3, and more preferably less than about 2, nanograms per liter (ηg/L.).

The elimination of color and odor materials can either be accomplished after formation of the compound, or, preferably, by selection of the reactants and the reaction conditions. Preferably, the reactants are selected to have good odor and color. For example, it is possible to obtain fatty acids, or their esters, for sources of the long fatty acyl group, that have good color and odor and which have extremely low levels of short chain ($C_{4-12}$, especially $C_{6-10}$) fatty acyl groups. Also, the reactants can be cleaned up prior to use. For example, the fatty acid reactant can be double or triple distilled to remove color and odor causing bodies and remove short chain fatty acids. Additionally, the color of the triethanolamine reactant needs to be controlled to a low color level (e.g. a color reading of about 20 or less on the APHA scale). The degree of clean up required is dependent on the level of use and the presence of other ingredients. For example, adding a dye can cover up some colors. However, for clear and/or light colored products, the color must be almost non-detectable. This is especially true for higher levels of active, e.g., from about 2% to about 80%, preferably from about 13% to about 75%, more preferably from about 17% to about 70%, and even more preferably from about 19% to about 65% of the softener active by weight of the composition. Similarly, the odor can be covered up by higher levels of perfume, but at the higher levels of softener active there is a relatively high cost associated with such an approach, especially in terms of having to compromise the odor quality. Odor quality can be further improved by use of ethanol as the quaternization reaction solvent.

A preferred biodegradable fabric softener compounds comprises quaternary ammonium salt, the quaternized ammonium salt being a quaternized product of condensation between:

a)-a fraction of saturated or unsaturated, linear or branched fatty acids, or of derivatives of said acids, said fatty acids or derivatives each possessing a hydrocarbon chain in which the number of atoms is between 5 and 21, and b)-triethanolamine, characterized in that said condensation product has an acid value, measured by titration of the condensation product with a standard KOH solution against a phenolphthalein indicator, of less than about 6.5.

The acid value is preferably less than or equal to about 5, more preferably less than about 3. Indeed, the lower the AV, the better softness performance is obtained.

The acid value is determined by titration of the condensation product with a standard KOH solution against a phenolphthalein indicator according to ISO#53402. The AV is expressed as mg KOH/g of the condensation product.

For optimum softness benefit, it is preferred that the reactants are present in a molar ratio of fatty acid fraction to triethanolamine of from about 1:1 to about 2.5:1.

It has also been found that the optimum softness performance is also affected by the detergent carry-over laundry conditions, and more especially by the presence of the anionic surfactant in the solution in which the softening composition is used. Indeed, the presence of anionic surfactant that is usually carried over from the wash will interact with the softener compound, thereby reducing its performance. Thus, depending on usage conditions, the mole ratio of fatty acid/triethanolamine can be critical. Accordingly, where no rinse occurs between the wash cycle and the rinse cycle containing the softening compound, a high amount of anionic surfactant will be carried over in the rinse cycle containing the softening compound. In this instance, it has been found that a fatty acid fraction/triethanolamine mole ratio of about 1.4:1 to about 1.8:1 is preferred. By high amount of anionic surfactant, it is meant that the presence of anionic in the rinse cycle at a level such that the molar ratio anionic surfactant/cationic softener compound of the invention is at least about 1/10.

A method of treating fabrics comprises the step of contacting the fabrics in an aqueous medium containing the above softener compounds or softening composition wherein the fatty acid/triethanolamine mole ratio in the softener compound is from about 1.4:1 to about 1.8:1, preferably about 1.5:1 and the aqueous medium comprises a molar ratio of anionic surfactant to said softener compound of the invention of at least about 1:10.

When an intermediate rinse cycle occurs between the wash and the later rinse cycle, less anionic surfactant, i.e. less than about 1:10 of a molar ratio anionic surfactant to cationic compound of the invention, will then be carried over. Accordingly, it has been found that a fatty acid/triethanolamine mole ratio of about 1.8:1 to about 2.2:1 is then preferred. I.e., then the method of treating fabrics comprises the step of contacting the fabrics in an aqueous medium containing the softener compound of the invention or softening composition thereof wherein the fatty acid/triethanolamine mole ratio in the softener compound is from about 1.8:1 to about 2:1, preferably about 2.0:1, and most preferably about 1.9, and the aqueous medium comprises a molar ratio of anionic surfactant to said softener compound of the invention of less than about 1:10.

In a preferred embodiment the fatty acid fraction and the triethanolamine are present in a molar ratio of from about 1:1 to about 2.5:1.

Preferred cationic, preferably biodegradable quaternary, ammonium fabric softening compounds can contain the group —(O)$CR^1$ which is derived from animal fats, unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of fatty acids (FA) are listed in U.S. Pat. No. 5,759,990 at column 4, lines 45–66.

Mixtures of fatty acids, and mixtures of FAs that are derived from different fatty acids can be used, and are preferred. Nonlimiting examples of FA's that can be blended, to form FA's of this invention are as follows:

| Fatty Acyl Group | $FA^1$ | $FA^2$ | $FA^3$ |
|---|---|---|---|
| $C_{14}$ | 0 | 0 | 1 |
| $C_{16}$ | 3 | 11 | 25 |
| $C_{18}$ | 3 | 4 | 20 |
| C14:1 | 0 | 0 | 0 |
| C16:1 | 1 | 1 | 0 |
| C18:1 | 79 | 27 | 45 |
| C18:2 | 13 | 50 | 6 |

-continued

| Fatty Acyl Group | $FA^1$ | $FA^2$ | $FA^3$ |
|---|---|---|---|
| C18:3 | 1 | 7 | 0 |
| Unknowns | 0 | 0 | 3 |
| Total | 100 | 100 | 100 |
| IV | 99 | 125–138 | 56 |
| cis/trans (C18:1) | 5–6 | Not Available | 7 |
| TPU | 14 | 57 | 6 |

$FA^1$ is a partially hydrogenated fatty acid prepared from canola oil,
$FA^2$ is a fatty acid prepared from soy bean oil, and
$FA^3$ is a slightly hydrogenated tallow fatty acid.

Preferred softener actives contain an effective amount of molecules containing two ester linked hydrophobic groups [$R^1C(CO)O$—], said actives being referred to hereinafter as "DEQA's", are those that are prepared as a single DEQA from blends of all the different fatty acids that are represented (total fatty acid blend), rather than from blends of mixtures of separate finished DEQA's that are prepared from different portions of the total fatty acid blend.

It is preferred that at least a majority of the fatty acyl groups are unsaturated, e.g., from about 50% to 100%, preferably from about 55% to about 99%, more preferably from about 60% to about 98%, and that the total level of active containing polyunsaturated fatty acyl groups (TPU) be preferably from 0% to about 30%. The cis/trans ratio for the unsaturated fatty acyl groups is usually important, with the cis/trans ratio being from about 1:1 to about 50:1, the minimum being about 1:1, preferably at least about 3:1, and more preferably from about 4:1 to about 20:1. (As used herein, the "percent of softener active" containing a given $R^1$ group is the same as the percentage of that same $R^1$ group is to the total $R^1$ groups used to form all of the softener actives.)

The unsaturated, including the preferred polyunsaturated, fatty acyl and/or alkylene groups, discussed hereinbefore and hereinafter, surprisingly provide effective softening, but also provide better rewetting characteristics, good antistatic characteristics, and especially, superior recovery after freezing and thawing.

The highly unsaturated materials are also easier to formulate into concentrated premixes that maintain a low viscosity for the neat product composition and are therefore easier to process, e.g., pump, mixing, etc. These highly unsaturated materials (total level of active containing polyunsaturated fatty acyl groups (TPU) being typically from about 3% to about 30%, with only the low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable compositions of the present invention, even at ambient temperatures. This ability to process the actives at low temperatures is especially important for the polyunsaturated groups, since it minimizes degradation. Additional protection against degradation can be provided when the compounds and softener compositions contain effective antioxidants, chelants, and/or reducing agents, as disclosed hereinafter.

It will be understood that substituents R and $R^1$ can optionally be substituted with various groups such as alkoxyl or hydroxyl groups, and can be straight, or branched so long as the $R^1$ groups maintain their basically hydrophobic character.

A preferred long chain DEQA is the DEQA prepared from sources containing high levels of polyunsaturation, i.e., N,N-di(acyl-oxyethyl)-N,N-methylhydroxyethylammonium methyl sulfate, where the acyl is derived from fatty acids containing sufficient polyunsaturation, e.g., mixtures of tallow fatty acids and soybean fatty acids. Another preferred long chain DEQA is the dioleyl (nominally) DEQA, i.e., DEQA in which N,N-di(oleoyl-oxyethyl)-N,N-methylhydroxyethylammonium methyl sulfate is the major ingredient. Preferred sources of fatty acids for such DEQAs are vegetable oils, and/or partially hydrogenated vegetable oils, with high contents of unsaturated, e.g., oleoyl groups.

As used herein, when the DEQA diester (m=2) is specified, it can include the monoester (m=1) and/or triester (m=3) that are present. Preferably, at least about 30% of the DEQA is in the diester form, and from 0% to about 30% can be DEQA monoester, e.g., there are three R groups and one $R^1$ group. For softening, under no/low detergent carry-over laundry conditions the percentage of monoester should be as low as possible, preferably no more than about 15%. However, under high, anionic detergent surfactant or detergent builder carry-over conditions, some monoester can be preferred. The overall ratios of diester "quaternary ammonium active" (quat) to monoester quat are from about 2.5:1 to about 1:1, preferably from about 2.3:1 to about 1.3:1. Under high detergent carry-over conditions, the di/monoester ratio is preferably about 1.3:1. The level of monoester present can be controlled in manufacturing the DEQA by varying the ratio of fatty acid, or fatty acyl source, to triethanolamine. The overall ratios of diester quat to triester quat are from about 10:1 to about 1.5:1, preferably from about 5:1 to about 2.8:1.

The above compounds can be prepared using standard reaction chemistry. In one synthesis of a di-ester variation of DTDMAC, triethanolamine of the formula $N(CH_2CH_2OH)_3$ is esterified, preferably at two hydroxyl groups, with an acid chloride of the formula $R^1C(O)Cl$, to form an amine which can be made cationic by acidification (one R is H) to be one type of softener, or then quaternized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

In preferred DEQA (1) and DEQA (2) softener actives, each $R^1$ is a hydrocarbyl, or substituted hydrocarbyl, group, preferably, alkyl, monounsaturated alkenyl, and polyunsaturated alkenyl groups, with the softener active containing polyunsaturated alkenyl groups being preferably at least about 3%, more preferably at least about 5%, more preferably at least about 10%, and even more preferably at least about 15%, by weight of the total softener active present; the actives preferably containing mixtures of $R^1$ groups, especially within the individual molecules.

The DEQAs herein can also contain a low level of fatty acid, which can be from unreacted starting material used to form the DEQA and/or as a by-product of any partial degradation (hydrolysis) of the softener active in the finished composition. It is preferred that the level of free fatty acid be low, preferably below about 15%, more preferably below about 10%, and even more preferably below about 5%, by weight of the softener active.

The fabric softener actives herein are preferably prepared by a process wherein a chelant, preferably a diethylenetriaminepentaacetate (DTPA) and/or an ethylene diamine-N, N'-disuccinate (EDDS) is added to the process. Another acceptable chelant is tetrakis-(2-hydroxylpropyl) ethylenediamine (TPED). Also, preferably, antioxidants are added to the fatty acid immediately after distillation and/or fractionation and/or during the esterification reactions and/or postadded to the finished softener active. The resulting softener active has reduced discoloration and malodor associated therewith.

The total amount of added chelating agent is preferably within the range of from about 10 ppm to about 5,000 ppm, more preferably within the range of from about 100 ppm to about 2500 ppm by weight of the formed softener active. The source of triglyceride is preferably selected from the group consisting of animal fats, vegetable oils, partially hydrogenated vegetable oils, and mixtures thereof. More preferably, the vegetable oil or partially hydrogenated vegetable oil is selected from the group consisting of canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, and mixtures thereof. Most preferably, the source of triglyceride is canola oil, partially hydrogenated canola oil, and mixtures thereof. The process can also include the step of adding from about 0.01% to about 2% by weight of the composition of an antioxidant compound to any or all of the steps in the processing of the triglyceride up to, and including, the formation of the fabric softener active.

The above processes produce a fabric softener active with reduced coloration and malodor.

Preparation of a fabric softening premix composition comprises preparing a fabric softening active as described above and mixing the fabric softener active, optionally containing a low molecular weight solvent, with a principal solvent having a ClogP, as described hereinafter, of from about −2.0 to about 2.6 thereby forming a fabric softener premix. The premix can comprise from about 55% to about 85% by weight of fabric softening active and from about 10% to about 30% by weight of principal solvent. Again, the process can also include the step of adding from about 0.01% to about 2% by weight of the composition of an antioxidant compound to any or all of the processing steps.

3) Polyquaternary Ammonium Compounds

The following polyquaternary ammonium compounds are disclosed by reference herein as suitable for use in this invention:

European Patent Application EP 0,803,498, A1, Robert O. Keys and Floyd E. Friedli, filed Apr. 25, 1997; British Pat. 808,265, issued Jan. 28, 1956 to Arnold Hoffman & Co., Incorporated; British Pat. 1,161,552, Koebner and Potts, issued Aug. 13, 1969; DE 4,203,489 A1, Henkel, published Aug. 12, 1993; EP 0,221,855, Topfl, Heinz, and Jorg, issued Nov. 3, 1986; EP 0,503,155, Rewo, issued Dec. 20, 1991; EP 0,507,003, Rewo, issued Dec. 20, 1991; EPA 0,803,498, published Oct. 29, 1997; French Pat. 2,523,606, Marie-Helene Fraikin, Alan Dillarstone, and Marc Couterau, filed Mar. 22, 1983; Japanese Pat. 84-273918, Terumi Kawai and Hiroshi Kitamura, 1986; Japanese Pat. 2-011,545, issued to Kao Corp., Jan. 16, 1990; U.S. Pat. No. 3,079,436, Hwa, issued Feb. 26, 1963; U.S. Pat. No. 4,418,054, Green et al., issued Nov. 29, 1983; U.S. Pat. 4,721,512, Topfl, Abel, and Binz, issued Jan. 26, 1988; U.S. Pat. No. 4,728,337, Abel, Topfl, and Riehen, issued Mar. 1, 1988; U.S. Pat. No. 4,906,413, Topfl and Binz, issued Mar. 6, 1990; U.S. Pat. No. 5,194,667, Oxenrider et al., issued Mar. 16, 1993; U.S. Pat. No. 5,235,082, Hill and Snow, issued Aug. 10, 1993; U.S. Pat. No. 5,670,472, Keys, issued Sep. 23, 1997; Weirong Miao, Wei Hou, Lie Chen, and Zongshi Li, Studies on Multifunctional Finishing Agents, Riyong Huaxue Gonye, No. 2, pp. 8–10, 1992; Yokagaku, Vol. 41, No. 4 (1992); and Disinfection, Sterilization, and Preservation, 4th Edition, published 1991 by Lea & Febiger, Chapter 13, pp. 226–30. All of these references are incorporated herein, in their entirety, by reference. The products formed by quaternization of reaction products of fatty acid with N,N,N',N', tetraakis (hydroxyethyl)-1,6-diaminohexane are also disclosed as suitable for this invention. Some nonlimiting structural examples produced by this reaction are given below:

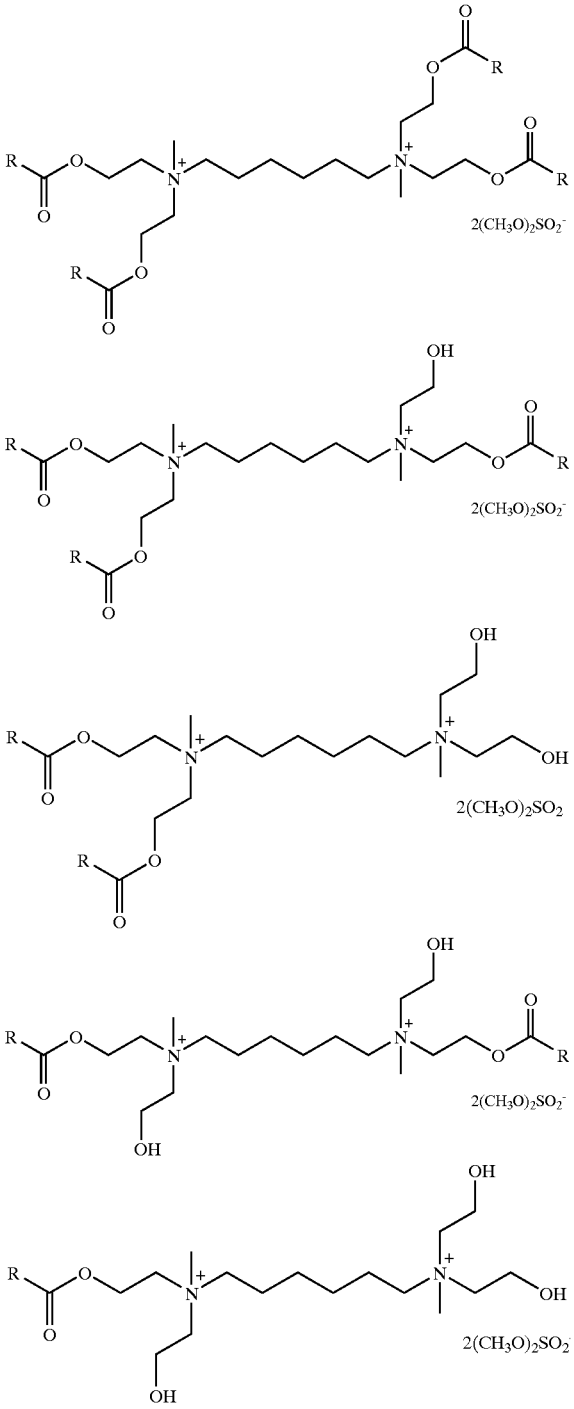

-continued
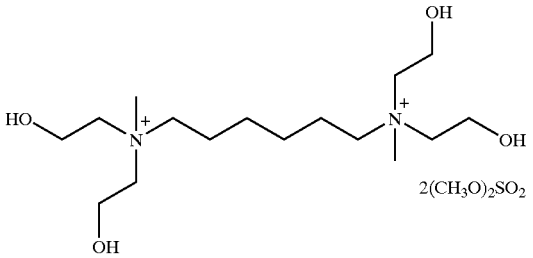
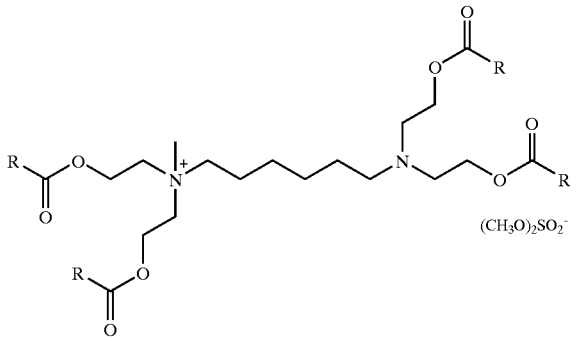
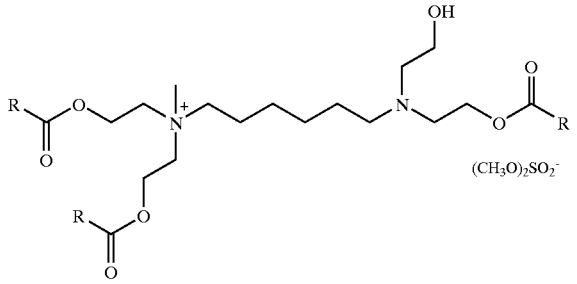
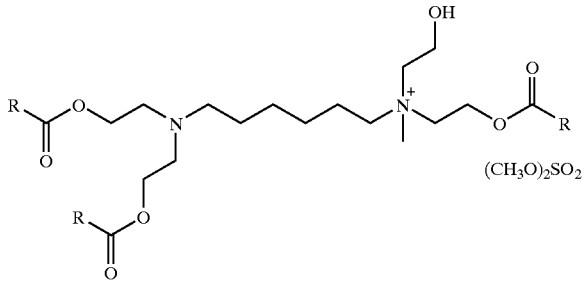
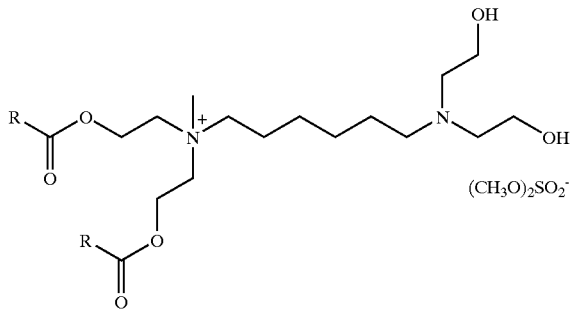
-continued
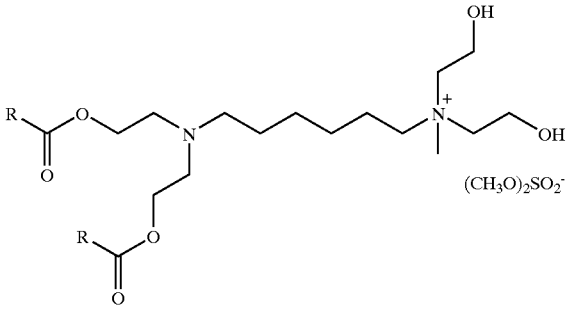
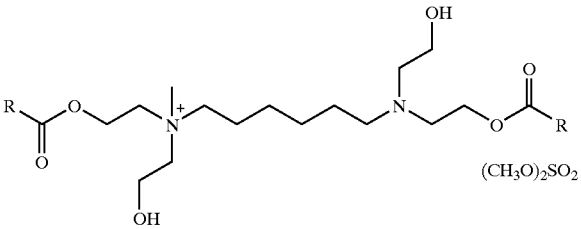
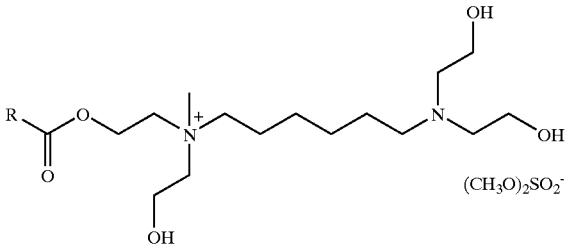
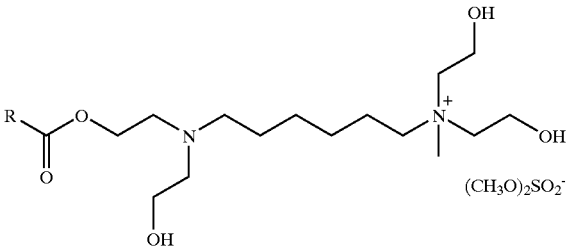
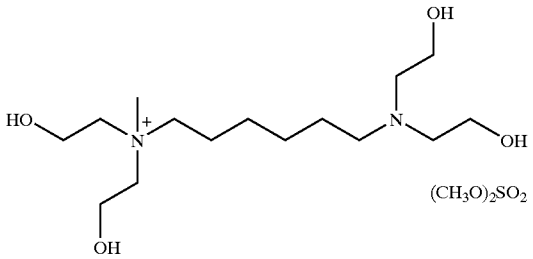
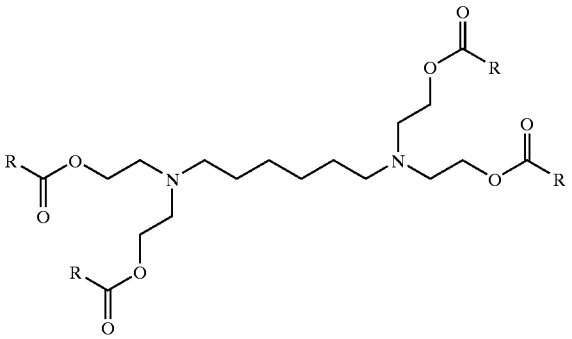

-continued

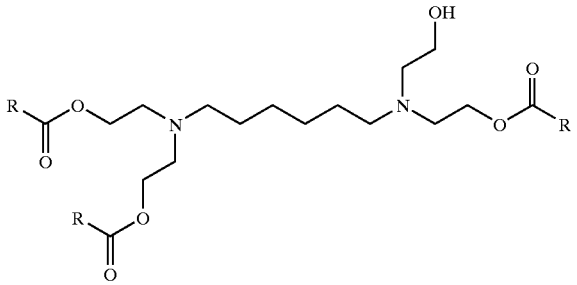

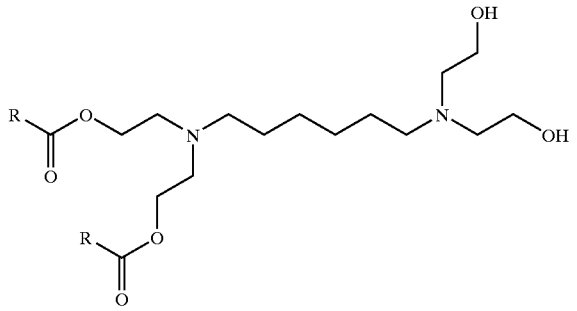

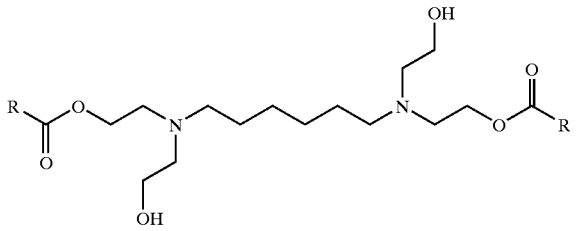

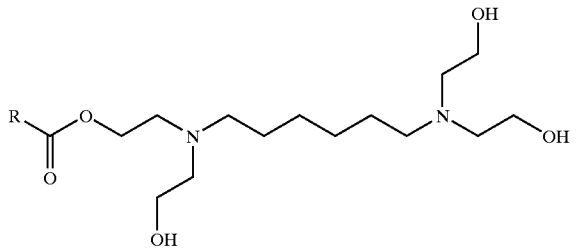

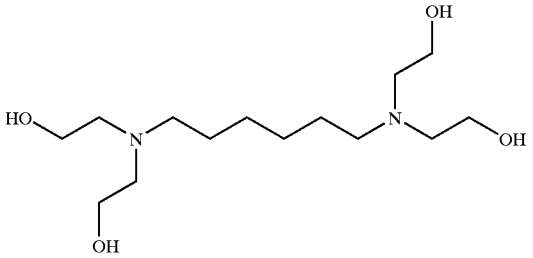

and R is defined as $R^1$ as described above.

Other Softener Actives

The compositions can also contain other fabric softener active(s), said other fabric softener active being selected from:

(1) softener having the formula:

$$[R_{4-m}—N^{(+)}—R^1_m]\,A^-$$

wherein each m is 2 or 3, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl, and where the Iodine Value (hereinafter referred to as "IV") of a fatty acid containing this $R^1$ group is from about 70 to about 140, more preferably from about 80 to about 130; and most preferably from about 90 to about 115 (as used herein, the term "Iodine Value" means the Iodine Value of a "parent" fatty acid, or "corresponding" fatty acid, which is used to define a level of unsaturation for an $R^1$ group that is the same as the level of unsaturation that would be present in a fatty acid containing the same $R^1$ group) with, preferably, a cis/trans ratio of from about 1:1 to about 50:1, the minimum being 1:1, preferably from about 2:1 to about 40:1, more preferably from about 3:1 to about 30:1, and even more preferably from about 4:1 to about 20:1; each $R^1$ can also preferably be a branched chain $C_{14}$–$C_{22}$ alkyl group, preferably a branched chain $C_{16}$–$C_{18}$ group; each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2O)_{2-4}H$ where each $R^2$ is a $C_{1-6}$ alkylene group; and $A^-$ is a softener compatible anion, preferably, chloride, bromide, methylsulfate, ethylsulfate, sulfate, and nitrate, more preferably chloride and methyl sulfate;

(2) softener having the formula:

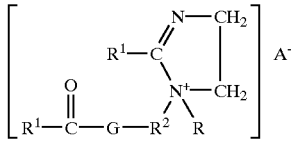

wherein each R, $R^1$, and $A^-$ have the definitions given above; each $R^2$ is a $C_{1-6}$ alkylene group, preferably an ethylene group; and G is an oxygen atom or an —NR— group;

(3) softener having the formula:

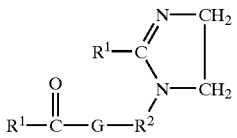

wherein $R^1$, $R^2$ and G are defined as above;

(4) reaction products of substantially unsaturated and/or branched chain higher fatty acids with dialkylenetriamines in, e.g., a molecular ratio of about 2:1, said reaction products containing compounds of the formula:

$$R^1—C(O)—NH—R^2—NH—R^3\mathbf{13}\ NH—C(O)—R^1$$

wherein $R^1$, $R^2$ are defined as above, and each $R^3$ is a $C_{1-6}$ alkylene group, preferably an ethylene group;

(5) softener having the formula:

$$[R^1—C(O)—NR—R^2—N(R)_2—R^3—NR—C(O)—R^1]^+A^-$$

wherein R, $R^1$, $R^2$, $R^3$ and $A^-$ are defined as above;

(6) the reaction product of substantially unsaturated and/or branched chain higher fatty acid with hydroxyalkylalkylenediamines in a molecular ratio of about 2:1, said reaction products containing compounds of the formula:

$$R^1—C(O)—NH—R^2—N(R^3OH)—C(O)—R^1$$

wherein $R^1$, $R^2$ and $R^3$ are defined as above;

(7) softener having the formula:

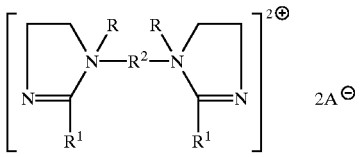

wherein R, $R^1$, $R^2$, and $A^-$ are defined as above.

Other optional but highly desirable cationic compounds which can be used in combination with the above softener actives are compounds containing one long chain acyclic $C_8$–$C_{22}$ hydrocarbon group, selected from the group consisting of:

(8) acyclic quaternary ammonium salts having the formula:

$$[R^1—N(R^5)_2—R^6]^+A^-$$

wherein $R^5$ and $R^6$ are $C_1$–$C_4$ alkyl or hydroxyalkyl groups, and $R^1$ and $A^-$ are defined as herein above;

(9) substituted imidazolinium salts having the formula:

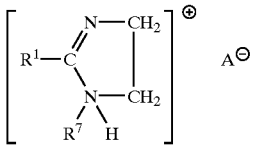

wherein $R^7$ is hydrogen or a $C_1$–$C_4$ saturated alkyl or hydroxyalkyl group, and $R^1$ and $A^-$ are defined as hereinabove;

(10) substituted imidazolinium salts having the formula:

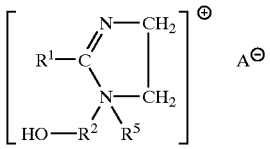

wherein $R^5$ is a $C_1$–$C_4$ alkyl or hydroxyalkyl group, and $R^1$, $R^2$, and $A^-$ are as defined above;

(11) alkylpyridinium salts having the formula:

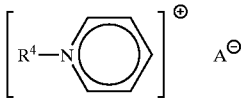

wherein $R^4$ is an acyclic aliphatic $C_8$–$C_{22}$ hydrocarbon group and $A^-$ is an anion; and

(12) alkanamide alkylene pyridinium salts having the formula:

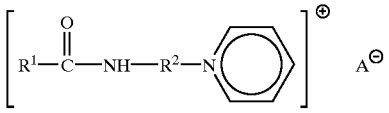

wherein $R^1$, $R^2$ and $A^-$ are defined as herein above; and mixtures thereof.

Examples of Compound (8) are the monoalkenyltrimethylammonium salts such as monooleyltrimethylammonium chloride, monocanolatrimethylammonium chloride, and soyatrimethylammonium chloride. Monooleyltrimethylammonium chloride and monocanolatrimethylammonium chloride are preferred. Other examples of Compound (8) are soyatrimethylammonium chloride available from Witco Corporation under the trade name Adogen® 415, erucyltrimethylammonium chloride wherein $R^1$ is a $C_{22}$ hydrocarbon group derived from a natural source; soyadimethylethylammonium ethylsulfate wherein $R^1$ is a $C_{16}$–$C_{18}$ hydrocarbon group, $R^5$ is a methyl group, $R^6$ is an ethyl group, and $A^-$ is an ethylsulfate anion; and methyl bis(2-hydroxyethyl) oleylammonium chloride wherein $R^1$ is a $C_{18}$ hydrocarbon group, $R^5$ is a 2-hydroxyethyl group and $R^6$ is a methyl group.

Additional fabric softeners that can be used herein are disclosed, at least generically for the basic structures, in U.S. Pat. Nos. 3,861,870, Edwards and Diehl; 4,308,151, Cambre; 3,886,075, Bernardino; 4,233,164, Davis; 4,401,578, Verbruggen; 3,974,076, Wiersema and Rieke; and 4,237,016, Rudkin, Clint, and Young, all of said patents being incorporated herein by reference. The additional softener actives herein are preferably those that are highly unsaturated versions of the traditional softener actives, i.e., di-long chain alkyl nitrogen derivatives, normally cationic materials, such as dioleyldimethylammonium chloride and imidazolinium compounds as described hereinafter. Examples of more biodegradable fabric softeners can be found in U.S. Pat. Nos. 3,408,361, Mannheimer, issued Oct. 29, 1968; 4,709,045, Kubo et al., issued Nov. 24, 1987; 4,233,451, Pracht et al., issued Nov. 11, 1980; 4,127,489, Pracht et al., issued Nov. 28, 1979; 3,689,424, Berg et al., issued Sep. 5, 1972; 4,128,485, Baumann et al., issued Dec. 5, 1978; 4,161,604, Elster et al., issued Jul. 17, 1979; 4,189,593, Wechsler et al., issued Feb. 19, 1980; and 4,339,391, Hoffman et al., issued Jul. 13, 1982, said patents being incorporated herein by reference.

Examples of Compound (1) are dialkylenedimethylammonium salts such as dicanoladimethylammonium chloride, dicanoladimethylammonium methylsulfate, di(partially hydrogenated soybean, cis/trans ratio of about 4:1) dimethylammonium chloride, dioleyldimethylammonium chloride. Dioleyldimethylammonium chloride and di(canola)dimethylammonium chloride are preferred. An example of commercially available dialkylenedimethylammonium salts usable in the present invention is dioleyldimethylammonium chloride available from Witco Corporation under the trade name Adogen® 472.

An example of Compound (2) is 1-methyl-1-oleylamidoethyl-2-oleylimidazolinium methylsulfate wherein $R^1$ is an acyclic aliphatic $C_{15}$–$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft® 3690.

An example of Compound (3) is 1-oleylamidoethyl-2-oleylimidazoline wherein $R^1$ is an acyclic aliphatic $C_{15}$–$C_{17}$ hydrocarbon group, $R^2$ is an ethylene group, and G is a NH group.

An example of Compound (4) is reaction products of oleic acids with diethylenetriamine in a molecular ratio of about 2:1, said reaction product mixture containing N,N"-dioleoyidiethylenetriamine with the formula:

$$R^1—C(O)—NH—CH_2CH_2—NH—CH_2CH_2—NH—C(O)—R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

An example of Compound (5) is a difatty amidoamine based softener having the formula:

$$[R^1—C(O)—NH—CH_2CH_2—N(CH_3)(CH_2CH_2OH)—CH_2CH_2—NH—C(O)—R^1]^+CH_3SO_4—$$

wherein $R^1$—C(O) is oleoyl group, available commercially from the Witco Corporation under the trade name Varisoft® 222LT.

An example of Compound (6) is reaction products of oleic acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is oleoyl group of a commercially available oleic acid derived from a vegetable or animal source, such as Emersol® 223LL or Emersol® 7021, available from Henkel Corporation.

An example of Compound (7) is the diquaternary compound having the formula:

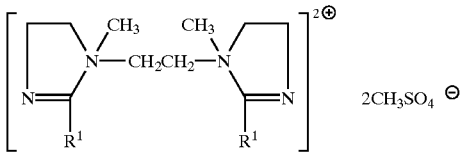

wherein $R^1$ is derived from oleic acid, and the compound is available from Witco Company.

An example of Compound (11) is 1-ethyl-1-(2-hydroxyethyl)-2-isoheptadecylimidazolinium ethylsulfate wherein $R^1$ is a $C_{17}$ hydrocarbon group, $R^2$ is an ethylene group, $R^5$ is an ethyl group, and $A^-$ is an ethylsulfate anion.

Anion A

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A. The anion can also, but less preferably, carry a double charge in which case $A^-$ represents half a group.

It will be understood that all combinations of softener structures disclosed above are suitable for use in this invention.

Optional Principal Solvent System

The principal solvent, when present, is typically used at an effective level up to about 40% by weight, preferably from about 1% to about 25%, more preferably from about 3% to about 8%, by weight of the composition. An advantage of the high electrolyte level and/or the phase stabilizers disclosed in PCT Publication No. WO 99/27050 is that lower levels of principal solvents and/or a wider range of principal solvents can be used to provide clarity. E.g., without the high level of electrolyte, the ClogP of the principal solvent system disclosed therein would typically be limited to a range of from about 0.15 to about 0.64 as disclosed in U.S. Pat. No. 5,747,443. It is known that higher ClogP compounds, up to about 1 can be used when combined with other solvents as disclosed in U.S. Ser. No. 60/047,058, filed May 19, 1997, or with nonionic surfactants, and especially with phase stabilizers as previously disclosed U.S. Ser. No. 60/076,564 filed Mar. 2, 1998, both of said applications being incorporated herein by reference. With the electrolyte present, the level of principal solvent can be less and/or the ClogP range that is usable is broadened to include from about −2.0 to about 3.0, more preferably from about −1.7 to about 1.6, and even more preferably from about −1.0 to about 1.0.

With an optional electrolyte present, levels of principal solvent that are substantially less than about 15% by weight of the composition can be used, which is preferred for odor, safety and economy reasons. The phase stabilizer as defined hereinafter, in combination with a very low level of principal solvent is sufficient to provide good clarity and/or stability of the composition when the electrolyte is present. Said electrolyte and/or said phase stabilizer can be used to either make a composition translucent or clear, or can be used to increase the temperature range at which the composition is translucent or clear.

Principal solvents are efficient in that they provide the maximum advantage for a given weight of solvent. It is understood that "solvent", as used herein, refers to the effect of the principal solvent and not to its physical form at a given temperature, since some of the principal solvents are solids at ambient temperature.

Principal solvents that can be present are selected to minimize solvent odor impact in the composition and to provide a low viscosity to the final composition. For example, isopropyl alcohol is flammable and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 50° F. (about 10° C.), more preferably down to about 40° F. (about 4.4° C.) and are able to recover after storage down to about 20° F. (about 6.7° C.).

Other suitable solvents can be selected based upon their octanol/water partition coefficient (P). Octanol/water partition coefficient of a solvent is the ratio between its equilibrium concentration in octanol and in water. The partition coefficients of the solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.—Chim. Theor., 19, 71 (1984).

The principal solvents are typically selected from those having a ClogP of from −2.0 to 2.6, preferably from −1.7 to 1.6, and more preferably from −1.0 to 1.0.

The most preferred solvents can be identified by the appearance of the dilute treatment compositions used to treat fabrics. These dilute compositions have dispersions of fabric softener that exhibit a more uni-lamellar appearance than conventional fabric softener compositions. The closer to uni-lamellar the appearance, the better the compositions seem to perform. These compositions provide surprisingly good fabric softening as compared to similar compositions prepared in the conventional way with the same fabric softener active.

Operable solvents have been disclosed, listed under various listings, e.g., aliphatic and/or alicyclic diols with a given number of carbon atoms; mono-ols; derivatives of glycerine; alkoxylates of diols; and mixtures of all of the above can be found in said U.S. Pat. Nos. 5,759,990 and 5,747,443 and PCT Publication No. WO 97/03169, said patents and application being incorporated herein by reference. The most pertinent disclosure appearing at pages 24–82 and 94–108 (methods of preparation) of the WO 97/03169 specification and in columns 11–54 and 66–78 (methods of preparation) of the '443 patent. The '443 and PCT disclosures contain reference numbers to the Chemical Abstracts Service Registry numbers (CAS No.) for those compounds that have such a number and the other compounds have a method described, that can be used to prepare the compounds. Some inoperable solvents listed in the '443 disclosure can be used in mixtures with operable solvents and/or with the high electrolyte levels and/or phase stabilizers, to make concentrated fabric softener compositions that meet the stability/clarity requirements set forth herein.

Many diol solvents that have the same chemical formula can exist as many stereoisomers and/or optical isomers. Each isomer is normally assigned with a different CAS No. For examples, different isomers of 4-methyl-2,3-hexanediol are assigned to at least the following CAS Nos.: 146452-51-9; 146452-50-8; 146452-49-5; 146452-48-4; 123807-34-1; 123807-33-0; 123807-32-9; and 123807-31-8.

In the '443 and PCT specifications, each chemical formula is listed with only one CAS No. This disclosure is only for exemplification and is sufficient to allow the practice of the invention. The disclosure is not limiting. Therefore, it is understood that other isomers with other CAS Nos., and their mixtures, are also included. By the same token, when a CAS No. represents a molecule which contains some particular isotopes, e.g., deuterium, tritium, carbon-13, etc., it is understood that materials which contain naturally distributed isotopes are also included, and vice versa.

There is a clear similarity between the acceptability (formulatability) of a saturated diol and its unsaturated homologs, or analogs, having higher molecular weights. The unsaturated homologs/analogs have the same formulatability as the parent saturated solvent with the condition that the unsaturated solvents have one additional methylene (viz., $CH_2$) group for each double bond in the chemical formula. In other words, there is an apparent "addition rule" in that for each good saturated solvent of this invention, which is suitable for the formulation of clear, concentrated fabric softener compositions, there are suitable unsaturated solvents where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant with respect to the chemical formula of the "parent" saturated solvent. This is due to a surprising fact that adding a —$CH_2$— group to a solvent chemical formula has an effect of increasing its ClogP value by about 0.53, while removing two adjacent hydrogen atoms to form a double bond has an effect of decreasing its ClogP value by about a similar amount, viz., about 0.48, thus about compensating for the —$CH_2$— addition. Therefore one goes from a preferred saturated solvent to the preferred higher molecular weight unsaturated analogs/homologs containing at least one more carbon atom by inserting one double bond for each additional $CH_2$ group, and thus the total number of hydrogen atoms is kept the same as in the parent saturated solvent, as long as the ClogP value of the new solvent remains within the effective range. The following are some illustrative examples:

It is possible to substitute for part of the principal solvent mixture a secondary solvent, or a mixture of secondary solvents, which by themselves are not operable as a principal solvent of this invention, as long as an effective amount of the operable principal solvents of this invention is still present in the liquid concentrated, clear fabric softener composition. An effective amount of the principal solvents of this invention is at least greater than about 1%, preferably more than about 3%, more preferably more than about 5% of the composition, when at least about 15% of the softener active is also present.

Principal solvents preferred for improved clarity at 50° F. are 1,2-hexanediol; 1,2-pentanediol; hexylene glycol; 1,2-butanediol; 1,4-cyclohexanediol; pinacol; 1,5-hexanediol; 1,6-hexanediol; and/or 2,4-dimethyl-2,4-pentanediol.

Optional Electrolyte

The compositions of this invention can contain a low or a relatively high level of electrolyte, e.g., from 0% up, normally from about 0.5% to about 10%, preferably from about 0.75% to about 3%, and more preferably from about 1% to about 2%, by weight of the composition. Increasing the electrolyte level in a clear/translucent formulation provides benefits such as (a) it lowers the amount of principal solvent having a ClogP of from about 0.15 to about 0.64 or 1, which is required to provide clarity (It can even eliminate the need for such a principal solvent completely.); (b) it modifies the viscosity/elasticity profile on dilution, to provide lower viscosity and/or elasticity; and (c) it modifies the range of ClogP of acceptable principal solvents that will provide clarity/translucency.

U.S. Pat. No. 5,759,990, incorporated herein by reference, discloses that the principal solvent in clear formulations should have a ClogP of from about 0.15 to about 0.64. A high electrolyte level allows the use of principal solvents with a ClogP of from about −2.0 to about 2.6, preferably from about −1.7 to about 1.6, and more preferably from about −1.0 to about 1.0. The principal solvents are also more effective with the high electrolyte level, thus allowing one to use less of such principal solvents.

Electrolytes significantly modify the microstructures and/or alter the phases that the products dilute through compared to products with no or lowered levels of electrolyte. Cryogenic Transmission Electron Microscopy and Freeze-Fracture Transmission Electron Microscopy methods show that in products which gel or have an unacceptable increase in viscosity upon dilution, a highly concentrated, tightly packed dispersion of vesicles can be formed. Such vesicular dispersions are shown to have high elasticity using rheological measurements. It is believed that since these solutions have high elasticity, they resist the mechanical stress that can lead to effective mixing with water and thus good dilution.

It is therefore believed that fabric softener compositions with highly preferred dilution and dispensing behaviors can be identified by evaluating the visco-elastic behavior of a series of water dilutions of the fabric softener composition, or alternatively, by evaluating the visco-elastic properties of the maximum viscosity peak in the dilution series. The visco-elastic behavior of the fabric softening composition provides information on the tendency of the fabric softener composition to flow and disperse in a desirable manner when used by the consumer. Viscosity measures the ability of a fluid to flow (i.e. dissipate heat) when energy is applied, represented by G", the loss modulus. Elasticity, which is commonly denoted by the storage modulus G', measures the tendency of the fabric softener composition to be easily deformed as energy is applied. G' and G" are generally measured as functions of applied strain or stress. For the purposes of this invention, G' and G" are measured over a range of energy inputs which encompasses energies likely to be applied in common consumer practices (e.g., machine wash and hand wash processes, pre-dilution steps by hand and machine, machine dispenser use and machine-independent dispenser use). Measuring G' and G" adequately distinguishes fabric softener compositions that have preferred and highly preferred dilution and dispersion behaviors from fabric softener compositions which have less preferred behavior. Further details on rheological parameters as well as well as guidance for choosing instrumentation and making rheological measurements is available in the article on *Rheology Measurements* in the *Kirk-Othmer Encyclopedia of Chemical Technology* 3rd *Ed.,* 1982, John Wiley & Sons Publ.; *Rheology of Liquid Detergents* by R. S. Rounds in Surfactant Series Vol. 67: *Liquid Detergents* ed. K. -Y. Lai, Marcel Dekker, Inc. 1997; and *Introduction to Rheology,* Elsevier, 1989, H. A. Barnes, J. F. Hutton, and K. Walters.

There is a problem that appears when some clear formulas are diluted. Principal solvents, in general, promote facile dilution of clear concentrated formulas to less concentrated dispersions in the rinse liquor. However, when some formulas, especially those with lower levels of principal solvent, or formulas based on solvents which are not principal solvents, are diluted, they have unacceptable viscosity/elasticity profiles. Rheological parameters which describe preferred formulations are as follows: preferred G'≦about 20 Pa and G"≦about 6 Pa sec; more preferred G'≦about 3 Pa and G"≦about 2 Pa sec; even more preferred G'≦about 1 Pa G"≦about 1 Pa. Preferred, more preferred, and yet even more preferred formulas must maintain stated G' and G" values over a range of applied strains from about 0.1 to about 1.

Microscopy shows again that high electrolyte levels allow the creation of formulas at much lower solvent/softener levels that dilute through different microstructures and/or phases which have much lower visco-elasticity. It is believed that microstructures with much lower elasticity, easily yield to slight stresses caused by agitating water in a washing machine, automatic washing machine dispenser, or automatic dispensing device not affixed to the machine agitator such as the Downy® 'Ball'. This leads to good mixing with water and consequently good dispersion of the fabric softener composition and thus reduced fabric staining potential, less fabric softener composition residue left behind in machine or machine-independent dispensing devices, less build-up of fabric softener residue in dispensers, more fabric softener available in the rinse increasing deposition on clothes, more uniform deposition over the surface of all clothes.

The electrolytes herein include the usual ones found in opaque, dispersion-type, liquid fabric softener compositions and others that are not normally used in such compositions. It was previously believed that principal solvents were increasing the flexibility of both the fabric softener domain and the water domain and thus promoting the formation of a highly fluid, optically clear, compositions containing a bicontinuous fabric softener active phase. Unexpectedly, it is now found that electrolytes seem to provide the function of increasing the flexibility of the water domain through breaking up the hydrogen bond interactions via complexation with the water molecules. This appears to be the mechanism by which the use of high electrolyte allows the use of lower amounts of principal solvents and increases the range of operable principal solvents.

Although it is believed that electrolytes function by complexing with water and breaking the hydrogen bond structure of water, it is also believed that the head groups of the fabric softener active and the phase stabilizer must be able to complex with water to increase the steric repulsion that will prevent coalescence of the separate bicontinuous phases of fabric softener actives, thus improving the stability of the typical bicontinuous phase that is present when the fabric softener active is in a clear composition. Electrolytes that have anions that are termed "soft" or "polarizable" anions as discussed in Surfactants and Interfacial Phenomena, Second Edition, M. J. Rosen, pp. 194–5, are more preferred than "hard" or "less polarizable" anions because the polarizable anions are believed to be effective at breaking up the water structure without dehydrating the head groups of the fabric softeners and the phase stabilizers. An additional reason for preferring soft, polarizable anions is that these complex less strongly than the hard ions with the fabric softener cation and so we believe a stronger cationic charge is maintained on the fabric softener head groups in the presence of the soft anions. A stronger cationic charge on the fabric softener should also help stabilize the bicontinuous phase by preventing coalescence through maintaining greater electrostatic repulsion. A typical series of anions from soft to hard is: iodide; bromide; isocyanate; orthophosphate; chloride; sulfate; hydroxide; and fluoride. The harder anions lower the cloud point of conventional ethoxylated nonionic detergent surfactants more, showing that the harder anions tend to dehydrate the head groups of the ethoxylated surfactants used as phase stabilizers.

For example, salts that lower the cloud point of a 1% solution of Neodol® 91-8 to less than about 65° C. are less preferred in the fabric softener compositions described herein because the fabric softener compositions made with these salts tend to be cloudy at ambient temperatures. Typical approximate cloud points for such a solution are: sodium sulfate—about 54.1° C.; potassium sulfate—64.4° C.; ammonium sulfate—about 64.4° C.; calcium sulfate (no change—insoluble); magnesium sulfate—about 58.7° C.; sodium chloride—about 63–66.9° C.; potassium chloride—about 73.4° C.; ammonium chloride—about 73.8° C.; calcium chloride—about 73.8° C.; and magnesium chloride—about 69.8° C. Potassium acetate provides a cloud point of about 69.8° C., thus placing the acetate anion somewhere between the chloride and sulfate anions.

Inorganic salts suitable for reducing dilution viscosity include $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $Na_2SO_4$, $Na_2SO_3$, $NaNO_3$, $NaIO_3$, $Na_3(PO_4)$, $Na_4P_2O_7$, sodium silicate, sodium metasilicate, sodium tetrachloroaluminate, sodium tripolyphosphate (STPP), $Na_2Si_3O_7$, sodium zirconate, $CaF_2$, $CaCl_2$, $CaBr_2$, $CaI_2$, $CaSO_4$, $Ca(NO_3)_2$, Ca, KI, KBr, KCl, KF, $KNO_3$, $KIO_3$, $K_2SO_4$, $K_2SO_3$, $K_3(PO_4)$, $K_4(P_2O_7)$, potassium pyrosulfate, potassium pyrosulfite, LiI, LiBr, LiCl, LiF, $LiNO_3$, $AlF_3$, $AlCl_3$, $AlBr_3$, $AlI_3$, $Al_2(SO_4)_3$, $Al(PO_4)$, $Al(NO_3)_3$, aluminum silicate; including hydrates of these salts and including combinations of these salts or salts with mixed cations e.g. potassium alum $AlK(SO_4)_2$ and salts with mixed anions, e.g. potassium tetrachloroaluminate and sodium tetrafluoroaluminate. Salts incorporating cations from groups III, IVa, Va, VIa, VIIa, VIII, Ib, and IIb on the periodic chart with atomic numbers>13 are also useful in reducing dilution viscosity but less preferred due to their tendency to change oxidation states and thus they can adversely affect the odor or color of the formulation or lower weight efficiency. Salts with cations from group Ia or IIa with atomic numbers>20 as well as salts with cations from the lactinide or actinide series are useful in reducing dilution viscosity, but less preferred due to lower weight efficiency or toxicity. Mixtures of above salts are also useful.

Organic salts useful in this invention include, magnesium, sodium, lithium, potassium, zinc, and aluminum salts of the carboxylic acids including formate, acetate, proprionate, pelargonate, citrate, gluconate, lactate aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogencarbonate ($HCO_3^{-1}$) when the pH is suitable, alkyl and aromatic sulfates and sulfonates e.g. sodium methyl sulfate, benzene sulfonates and derivatives such as xylene sulfonate, and amino acids when the pH is suitable. Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Generally, inorganic electrolytes are preferred over organic electrolytes for better weight efficiency and lower costs. Mixtures of inorganic and organic salts can be used. Typical levels of electrolyte in the compositions are less than about 10%. Preferably from about 0.5% to about 5% by weight, more preferably from about 0.75% to about 2.5%, and most preferably from about 1% to about 2% by weight of the fabric softener composition.

Optional Phase Stabilizer

Phase stabilizers are highly desirable, and can be essential, to formulating a clear or translucent fabric softener composition (product) with high electrolyte levels. It is believed that clear and translucent products are comprised of surfactants structured in bilayers with an aqueous domain between these bilayers. Oily materials, such as hydrophobic perfumes, can be incorporated within the bilayers between the surfactant tails. In fact, these oily materials can act to stabilize the bilayers if the amount present is not excessive. Water soluble compounds, such as the electrolytes described above tend to stay in the aqueous domain between the bilayers.

It is believed that in cationic softener products with no or low electrolyte levels, the surfactant structure is normally stabilized by the electrostatic repulsion between the bilayers. Electrostatic repulsion prevents the surfactant bilayers from coalescing and thus splitting into separate phases. When a high level of electrolyte is added to the formula, it is believed that the electrostatic repulsion between bilayers is diminished and this can promote coalescence of the surfactant bilayers. If this coalescence occurs, one, or more, phase stabilizers is added to the formula to provide more stability, e.g., by steric repulsion between the bilayers.

Typical levels of phase stabilizer in the softening compositions are from an effective amount up to about 15% by weight, preferably from about 0.1% to about 7% by weight, more preferably from about 1% to about 5% by weight of the composition.

The phase stabilizer compounds described herein differ from the principal solvents described hereinbefore by their ability to provide steric repulsion at the interface. These phase stabilizers are not principal solvents as defined herein.

The phase stabilizers useful in the compositions of the present invention are selected surface actives materials commonly comprise of hydrophobic and hydrophilic moieties. A preferred hydrophilic moiety is polyalkoxylated group, preferably polyethoxylated group.

Preferred phase stabilizers are nonionic surfactants derived from saturated and/or unsaturated primary, secondary, and/or branched, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with $\leqq 50$, preferably $\leqq 30$, more preferably from about 5 to about 15, and even more preferably from about 8 to about 12, ethylene oxide moieties to provide an HLB of from about 8 to about 20, preferably from about 10 to about 18, and more preferably from about 11 to about 15.

Suitable phase stabilizers also include nonionic surfactants with bulky head groups selected from:

a. surfactants having the formula $$R^1—C(O)—Y'—[C(R^5)]_m—CH_2O(R_2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein $0 \leqq x \leqq$ about 3 and z is from about 5 to about 30; each $R^2$ is selected from the following groups or combinations of the following groups: $—(CH_2)_n—$ and/or $—[CH(CH_3)CH_2]—$; and each $R^5$ is selected from the following groups: —OH; and $—O(R^2O)_z—H$; and m is from about 2 to about 4;

b. surfactants having the formulas:

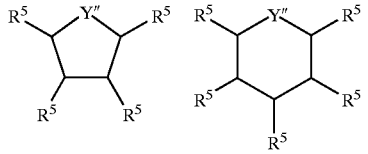

wherein Y"=N or O; and each $R^5$ is selected independently from the following: —H, —OH, $—(CH_2)xCH_3$, $—O(OR^2)_z—H$, $—OR^1$, $—OC(O)R^1$, and $—CH(CH_2—(OR^2)_{z''}—H)—CH_2—(OR^2)_{z'}—C(O)\ R^1$, x and $R^1$ are as defined above and $5 \leqq z, z', \text{and } z'' \leqq 20$, more preferably $5 \leqq z+z'+z'' \leqq 20$, and most preferably, the heterocyclic ring is a five member ring with Y"=O, one $R^5$ is —H, two $R^5$ are —O—($R^2$O)z—H, and at least one $R^5$ is the following structure —CH($CH_2$—($OR^2$)$_{z''}$—H)—$CH_2$—($OR^2$)$_{z'}$—C(O) $R^1$ with 8≦z+z'+z"≦20 and $R^1$ is a hydrocarbon with from 8 to 20 carbon atoms and no aryl group;

c. polyhydroxy fatty acid amide surfactants of the formula:

$$R^2—C(O)—N(R^1)—Z$$

wherein: each $R^1$ is H, $C_1$–$C_4$ hydrocarbyl, $C_1$–$C_4$ alkoxyalkyl, or hydroxyalkyl; and $R^2$ is a $C_5$–$C_{31}$ hydrocarbyl moiety; and each Z is a polyhydroxyhydrocarbyl moiety having a linear hydrocarbyl chain with at least 3 hydroxyls directly connected to the chain, or an ethoxylated derivative thereof; and each R' is H or a cyclic mono- or polysaccharide, or alkoxylated derivative thereof; and d. mixtures thereof.

Suitable phase stabilizers also include surfactant complexes formed by one surfactant ion being neutralized with surfactant ion of opposite charge or an electrolyte ion that is suitable for reducing dilution viscosity and block copolymer surfactants comprising polyethylene oxide moieties and propylene oxide moieties Examples of representative phase stabilizers include:

(1)—Alkyl or Alkyl-aryl Alkoxylated Nonionic Surfactants

Suitable alkyl alkoxylated nonionic surfactants are generally derived from saturated or unsaturated primary, secondary, and branched fatty alcohols, fatty acids, alkyl phenols, or alkyl aryl (e.g., benzoic) carboxylic acid, where the active hydrogen(s) is alkoxylated with≦about 30 alkylene, preferably ethylene, oxide moieties (e.g. ethylene oxide and/or propylene oxide). These nonionic surfactants for use herein preferably have from about 6 to about 22 carbon atoms on the alkyl or alkenyl chain, and are in either straight chain or branched chain configuration, preferably straight chain configurations having from about 8 to about 18 carbon atoms, with the alkylene oxide being present, preferably at the primary position, in average amounts of≦about 30 moles of alkylene oxide per alkyl chain, more preferably from about 5 to about 15 moles of alkylene oxide, and most preferably from about 8 to about 12 moles of alkylene oxide. Preferred materials of this class also have pour points of about 70° F. and/or do not solidify in these clear formulations. Examples of alkyl alkoxylated surfactants with straight chains include Neodol® 91-8, 25-9, 1-9, 25-12, 1-9, and 45-13 from Shell, Plurafac® B-26 and C-17 from BASF, and Brij® 76 and 35 from ICI Surfactants. Examples of branched alkyl alkoxylated surfactants include Tergitol® 15-S-12, 15-S-15, and 15-S-20 from Union Carbide and Emulphogene® BC-720 and BC-840 from GAF. Examples of alkyl-aryl alkoxylated surfactants include Igepal® CO-620 and CO-710, from Rhone Poulenc, Triton® N-111 and N-150 from Union Carbide, Dowfax® 9N5 from Dow and Lutensol® AP9 and AP14, from BASF.

(2)—Alkyl or Alkyl-aryl Amine or Amine Oxide Nonionic Alkoxylated Surfactants

Suitable alkyl alkoxylated nonionic surfactants with amine functionality are generally derived from saturated or unsaturated, primary, secondary, and branched fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having≦about 50 moles alkylene oxide moieties (e.g. ethylene oxide and/or propylene oxide) per mole of amine. The amine, amide or amine-oxide surfactants for use herein have from about 6 to about 22 carbon atoms, and are in either straight chain or branched chain configuration, preferably there is one hydrocarbon in a straight chain configuration having about 8 to about 18 carbon atoms with one or two alkylene oxide chains attached to the amine moiety, in average amounts of≦50 about moles of alkylene oxide per amine moiety, more preferably from about 5 to about 15 moles of alkylene oxide, and most preferably a single alkylene oxide chain on the amine moiety containing from about 8 to about 12 moles of alkylene oxide per amine moiety. Preferred materials of this class also have pour points about 70° F. and/or do not solidify in these clear formulations. Examples of ethoxylated amine surfactants include Berol® 397 and 303 from Rhone Poulenc and Ethomeens® C/20, C25, T/25, S/20, S/25 and Ethodumeens® T/20 and T25 from Akzo.

Preferably, the compounds of the alkyl or alkyl-aryl alkoxylated surfactants and alkyl or alkyl-aryl amine, amide, and amine-oxide alkoxylated have the following general formula:

$$R^1_m—Y—[(R^2—O)_z—H]_p$$

wherein each $R^1$ is selected from the group consisting of saturated or unsaturated, primary, secondary or branched chain alkyl or alkyl-aryl hydrocarbons; said hydrocarbon chain preferably having a length of from about 6 to about 22, more preferably from about 8 to about 18 carbon atoms, and even more preferably from about 8 to about 15 carbon atoms, preferably, linear and with no aryl moiety; wherein each $R^2$ is selected from the following groups or combinations of the following groups: —$(CH_2)_n$— and/or —[CH($CH_3$)$CH_2$]—; wherein about 1<n≦about 3; Y is selected from the following groups: —O—; —N(A)$_q$—; —C(O)O—; —(O←)N(A)$_q$—; —B—$R^3$—O—; —B—$R^3$—N(A)$_q$—; —B—$R^3$—C(O)O—; —B—$R^3$—N(→O)(A)—; and mixtures thereof; wherein A is selected from the following groups: H; $R^1$; —($R^2$—O)$_z$—H; —$(CH_2)_xCH_3$; phenyl, or substituted aryl, wherein 0≦x≦about 3 and B is selected from the following groups: —O—; —N(A)—; —C(O)O—; and mixtures thereof in which A is as defined above; and wherein each $R^3$ is selected from the following groups: $R^2$; phenyl; or substituted aryl. The terminal hydrogen in each alkoxy chain can be replaced by a short chain $C_{1-4}$ alkyl or acyl group to "cap" the alkoxy chain. z is from about 5 to about 30. p is the number of ethoxylate chains, typically one or two, preferably one and m is the number of hydrophobic chains, typically one or two, preferably one and q is a number that completes the structure, usually one.

Preferred structures are those in which m=1, p=1 or 2, and 5≦z≦30, and q can be 1 or 0, but when p=2, q must be 0; more preferred are structures in which m=1, p=1 or 2, and 7≦z≦20; and even more preferred are structures in which m=1, p=1 or 2, and 9≦z≦12. The preferred y is 0.

(3)—Alkoxylated and Non-alkoxylated Nonionic Surfactants With Bulky Head Groups

Suitable alkoxylated and non-alkoxylated phase stabilizers with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having≦about 50, preferably≦about 30, moles per mole of heterocyclic or carbohydrate. The hydrocarbon groups on the carbohydrate or heterocyclic surfactant for use herein have from about 6 to about 22 carbon atoms, and are in either straight chain or branched chain configuration, preferably there is one hydrocarbon having from about 8 to about 18 carbon atoms with one or two alkylene oxide chains carbohydrate or heterocyclic moiety with each alkylene oxide chain present in average amounts of≦about 50, preferably≦about 30, moles of carbohydrate or heterocyclic moiety, more preferably from about 5 to about 15 moles of alkylene oxide per alkylene oxide chain, and most preferably between about 8 and about 12 moles of alkylene oxide total per surfactant molecule including alkylene oxide on both the hydrocarbon chain and on the heterocyclic or carbohydrate moiety. Examples of phase stabilizers in this class are Tween® 40, 60, and 80 available from ICI Surfactants.

Preferably the compounds of the alkoxylated and non-alkoxylated nonionic surfactants with bulky head groups have the following general formulas:

$$R^1—C(O)—Y'—[C(R^5)]_m—CH_2O(R_2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein 0≦x≦about 3 and z is from about 5 to about 30; each $R^2$ is selected from the following groups or combinations of the following groups: $—(CH_2)_n—$ and/or $—[CH(CH_3)CH_2]—$; and each $R^5$ is selected from the following groups: —OH; and $—O(R^2O)_z—H$ ; and m is from about 2 to about 4;

Another useful general formula for this class of surfactants is

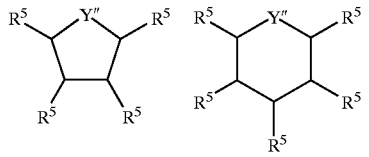

wherein Y"=N or O; and each $R^5$ is selected independently from the following: —H, —OH, $—(CH_2)xCH_3$, $—(OR^2)_z—H$, $—OR^1$, $—OC(O)R^1$, and $—CH_2(CH_2—(OR^2)_{z''}—H)—CH_2—(OR^2)_{z'}—C(O)\ R^1$. With x $R^1$, and $R^2$as defined above in section D above and z, z', and z" are all from about 5≦to≦about 20, more preferably the total number of z+z'+z" is from about 5≦to≦about 20. In a particularly preferred form of this structure the heterocyclic ring is a five member ring with Y"=O, one $R^5$ is —H, two $R^5$ are $—O—(R^2O)_z—H$, and at least one $R^5$ has the following structure $—CH(CH_2—(OR^2)_{z''}—H)—CH_2—(OR^2)_{z'}—OC(O)R^1$ with the total z+z"+z"=to from about 8≦to≦about 20 and $R^1$ is a hydrocarbon with from about 8 to about 20 carbon atoms and no aryl group.

Another group of surfactants that can be used are polyhydroxy fatty acid amide surfactants of the formula:

$$R^6—C(O)—N(R^7)—W$$

wherein: each $R^7$ is H, $C_1$–$C_4$ hydrocarbyl, $C_1$–$C_4$ alkoxyalkyl, or hydroxyalkyl, e.g., 2-hydroxyethyl, 2-hydroxypropyl, etc., preferably $C_1$–$C_4$ alkyl, more preferably $C_1$ or $C_2$ alkyl, most preferably $C_1$ alkyl (i.e., methyl) or methoxyalkyl; and $R^6$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and W is a polyhydroxyhydrocarbyl moiety having a linear hydrocarbyl chain with at least 3 hydroxyls directly connected to the chain, or an alkoxylated derivative (preferably ethoxylated or propoxylated) thereof. W preferably will be derived from a reducing sugar in a reductive amination reaction; more preferably W is a glycityl moiety. W preferably will be selected from the group consisting of $—CH_2—(CHOH)_n—CH_2OH$, $—CH(CH_2OH)—(CHOH)_n—CH_2OH$, $—CH_2—(CHOH)_2(CHOR')(CHOH)—CH_2OH$, where n is an integer from 3 to 5, inclusive, and R' is H or a cyclic mono- or poly-saccharide, and alkoxylated derivatives thereof. Most preferred are glycityls wherein n is 4, particularly $—CH_2—(CHOH)_4—CH_2O$. Mixtures of the above W moieties are desirable.

$R^6$ can be, for example, N-methyl, N-ethyl, N-propyl, N-isopropyl, N-butyl, N-isobutyl, N-2-hydroxyethyl, N-1-methoxypropyl, or N-2-hydroxypropyl.

$R^6—CO—N<$can be, for example, cocamide, stearamide, oleamide, lauramide, myristamide, capricamide, palmitamide, tallowamide, etc.

W can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

(4)—Alkoxylated Cationic Quaternary Ammonium Surfactants

Alkoxylated cationic quaternary ammonium surfactants suitable for this invention are generally derived from fatty alcohols, fatty acids, fatty methyl esters, alkyl substituted phenols, alkyl substituted benzoic acids, and/or alkyl substituted benzoate esters, and/or fatty acids that are converted to amines which can optionally be further reacted with another long chain alkyl or alkyl-aryl group; this amine compound is then alkoxylated with one or two alkylene oxide chains each having≦about 50 moles alkylene oxide moieties (e.g. ethylene oxide and/or propylene oxide) per mole of amine. Typical of this class are products obtained from the quaternization of aliphatic saturated or unsaturated, primary, secondary, or branched amines having one or two hydrocarbon chains from about 6 to about 22 carbon atoms alkoxylated with one or two alkylene oxide chains on the amine atom each having less than≦about 50 alkylene oxide moieties. The amine hydrocarbons for use herein have from about 6 to about 22 carbon atoms, and are in either straight chain or branched chain configuration, preferably there is one alkyl hydrocarbon group in a straight chain configuration having about 8 to about 18 carbon atoms. Suitable quaternary ammonium surfactants are made with one or two alkylene oxide chains attached to the amine moiety, in average amounts of≦about 50 moles of alkylene oxide per alkyl chain, more preferably from about 3 to about 20 moles of alkylene oxide, and most preferably from about 5 to about 12 moles of alkylene oxide per hydrophobic, e.g., alkyl group. Preferred materials of this class also have a pour points below about 70° F. and/or do not solidify in these clear formulations. Examples of suitable phase stabilizers of this type include Ethoquad® 18/25, C/25, and O/25 from Akzo and Variquat®-66 (soft tallow alkyl bis(polyoxyethyl) ammonium ethyl sulfate with a total of about 16 ethoxy units) from Witco.

Preferably, the compounds of the ammonium alkoxylated cationic surfactants have the following general formula:

$$\{R^1_m—Y—[(R^2—O)_z—H]_p\}^+X^-$$

wherein $R^1$ and $R^2$ are as defined previously in section D above;

Y is selected from the following groups: $=N^+—(A)_q$; $—(CH_2)_n—N^+—(A)_q$; $—B—(CH_2)_n—N^+—(A)_2$; -(phenyl)-$N^+—(A)_q$; —(B-phenyl)-$N^+—(A)_q$; with n being from about 1 to about 4.

Each A is independently selected from the following groups: H; $R^1$; $—(R^2O)_z—H$; $—(CH_2)_xCH_3$; phenyl, and substituted aryl; where $0 \leqq x \leqq$ about 3; and B is selected from the following groups: —O—; —NA—; $—NA_2$; —C(O)O—; and —C(O)N(A)—; wherein $R^2$ is defined as hereinbefore; q=1 or 2; and $X^-$ is an anion which is compatible with fabric softener actives and adjunct ingredients.

Preferred structures are those in which m=1, p=1 or 2, and about $5 \leqq z \leqq$ about 50, more preferred are structures in which m=1, p=1 or 2, and about $7 \leqq z \leqq$ about 20, and most preferred are structures in which m=1, p=1 or 2, and about $9 \leqq z \leqq$ about 12.

(5)—Surfactant Complexes

Surfactant complexes are considered to be surfactant ions neutralized with a surfactant ion of opposite charge or a surfactant neutralized with an electrolyte that is suitable for reducing dilution viscosity, an ammonium salt, or a polycationic ammonium salt. For the purpose of this invention, if a surfactant complex is formed by surfactants of opposite charge, it is preferable that the surfactants have distinctly different chain lengths e.g. a long-chain surfactant complexed with a short-chain surfactant to enhance the solubility of the complex and it is more preferable that the that the long chain surfactant be the amine or ammonium containing surfactant. Long chain surfactants are defined as containing alkyl chains with from about 6 to about 22 carbon atoms. These alkyl chains can optionally contain a phenyl or substituted phenyl group or alkylene oxide moieties between the chain and the head group. Short chain surfactants are defined as containing alkyl chains with less than 6 carbons and optionally these alkyl chains could contain a phenyl or substituted phenyl group or alkylene oxide moieties between the alkyl chain and the head group. Examples of suitable surfactant complexes include mixtures of Armeen® APA-10 and calcium xylene sulfonate, Armeen APA-10 and magnesium chloride, lauryl carboxylate and triethanol amine, linear alkyl benzene sulfonate and $C_5$-dimethyl amine, or alkyl ethoxylated sulfate and tetrakis N,N,N'N' (2-hydroxylpropyl) ethylenediamine.

Preferably, long-chain surfactants for making complexes have the following general formula:

$$R^1—Y^2$$

wherein $R^1$ is as hereinbefore from section D above and $Y^2$ can be chosen from the following structures: $—N(A)_2$; $—C(O)N(A)_2$; $—(O\leftarrow)N(A)_2$; $—B—R^3—N(A)_2$; $—B—R^3—C(O)N(A)_2$; $—B—R^3—N(\rightarrow O)(A)_2$; $—CO_2^-$; $—SO_3^{-2}$; $—OSO_3^{-2}$; $—O(R^2O)_xCO_2^-$; $—O(R^2O)_xSO_3^{-2}$; and $—O(R^2O)_xOSO_3^{-2}$; with B and $R^3$ as is hereinbefore section D above and $0 \leqq x \leqq 4$.

Preferably, short-chain surfactants for making complexes have the following general formula:

$$R^4—Y^2$$

wherein $R^1$, $R^3$, B, and $Y^2$are as hereinbefore and $R^4$ can be chosen from the following: $—(CH_2)_yCH_3$; $—(CH_2)_y$-phenyl or $—(CH_2)_y$-substituted phenyl with $0 \leqq y \leqq 6$ (6)—Block Copolymers Obtained by Copolymerization of Ethylene Oxide and Propylene Oxide Suitable polymers include a copolymer having blocks of terephthalate and polyethylene oxide. More specifically, these polymers are comprised of repeating units of ethylene and/or propylene terephthalate and polyethylene oxide terephthalate at a preferred molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymer is in the range of from about 5,000 to about 55,000.

Another preferred polymer is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

Highly preferred polymers have the generic formula:

$$X—(OCH_2CH_2)_n—[O—C(O)—R^1—C(O)—O—R^2)_u—[O—C(O)—R^1—C(O)—O)—(CH_2CH_2O)_n—X \quad (1)$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the desired properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) are adequate. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the polymer in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these polymers is contained in European Patent Application 185,427, Gosselink, published Jun. 25, 1986, incorporated herein by reference.

Other preferred copolymers include surfactants, such as the polyoxypropylene/polyoxyethylene/polyoxypropylene (PO/EO/PO) reverse block polymers.

The copolymer can optionally contain propylene oxide in an amount up to about 15% by weight. Other preferred copolymer surfactants can be prepared by the processes described in U.S. Pat. No. 4,223,163, issued Sep. 16, 1980, Builloty, incorporated herein by reference.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Certain of the block polymer surfactant compounds designated PLURONIC® and TETRONIC® by the BASF-Wyandotte Corp., Wyandotte, Mich., are suitable in compositions of the invention.

A particularly preferred copolymer contains from about 40% to about 70% of a polyoxypropylene/polyoxyethylene/polyoxypropylene block polymer blend comprising about 75%, by weight of the blend, of a reverse block copolymer of polyoxyethylene and polyoxypropylene containing 17 moles of ethylene oxide and 44 moles of propylene oxide; and about 25%, by weight of the blend, of a block copolymer of polyoxyethylene and polyoxypropylene initiated with trimethylolpropane and containing 99 moles of propylene oxide and 24 moles of ethylene oxide per mole of trimethylolpropane.

Suitable for use as copolymer are those having relatively high hydrophilic-lipophilic balance (HLB).

Other polymers useful herein include the polyethylene glycols having a molecular weight of from about 950 to about 30,000 which can be obtained from the Dow Chemical Company of Midland, Mich. Such compounds for example, have a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol with the requisite number of moles of ethylene oxide to provide the desired molecular weight and melting point of the respective polyethylene glycol.

(7)—Alkyl Amide Alkoxylated Nonionic Surfactants

Suitable surfactants have the formula:

$$R—C(O)—N(R^4)_n—[(R^1O)_x(R^2O)_yR^3]_m$$

wherein R is $C_{7-21}$ linear alkyl, $C_{7-21}$ branched alkyl, $C_{7-21}$ linear alkenyl, $C_{7-21}$ branched alkenyl, and mixtures thereof. Preferably R is $C_{8-18}$ linear alkyl or alkenyl.

$R^1$ is $—CH_2—CH_2—$, $R_2$ is $C_3$–$C_4$ linear alkyl, $C_3$–$C_4$ branched alkyl, and mixture thereof; preferably $R^2$ is $—CH(CH_3)—CH_2—$. Surfactants which comprise a mixture of R1 and R2 units preferably comprise from about 4 to about 12 $—CH_2—CH_2—$ units in combination with from about 1 to about 4 $—CH(CH_3)—CH_2—$ units. The units may be alternating or grouped together in any combination suitable to the formulator. Preferably the ratio of $R^1$ units to $R^2$ units is from about 4:1 to about 8:1. Preferably an $R^2$ unit (i.e. $—C(CH_3)H—CH_2—$) is attached to the nitrogen atom followed by the balance of the chain comprising from about 4 to 8 $—CH_2—CH_2—$ units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the R4 unit is absent.

The index m is 1 or 2, the index n is 0 or 1, provided that m+n equals 2; preferably m is equal to 1 and n is equal to 1, resulting in one $—[(R^1O)_x(R^2O)_yR^3]$ unit and R4 being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all the alkyleneoxy units are ethyleneoxy units.

Examples of suitable ethoxylated alkyl amide surfactants are Rewopal® $C_6$ from Witco, Amidox® C5 from Stepan, and Ethomid® O/17 and Ethomid® HT/60 from Akzo.; and (8).—Mixtures Thereof In terms of principal solvent reduction, with the invention compositions, a reduction of at least 30% can be made without impairing the performance of the composition compared to compositions without the phase stabilizers hereinbefore described. Using a preferred sub-class, a reduction of more than 50% is possible. These phase stabilizers provide an improved range of temperatures at which the compositions are clear and stable. They also allow more electrolyte to be used without instability. Finally, they can reduce the amount of principal solvent needed to achieve clarity and/or stability.

In order to reduce the amount of principal solvent used, the preferred phase stabilizers are alkoxylated alkyls, alkoxylated acyl amides, alkoxylated alkyl amines or alkoxylated quaternary alkyl ammonium salts, surfactant complexes, and mixtures thereof. The various stabilizers have different advantages. For example, alkoxylated cationic materials or cationic surfactant complexes improve softness and provide enhanced wrinkle release benefits.

Fabric softener compositions with highly preferred dilution and dispensing behaviors can be identified as disclosed hereinbefore.

Malodor Controlling Agent

The malodor controlling agent useful herein is selected from the group of consisting of cyclodextrins and mixtures thereof. Optionally, the malodor control agent can include an ammonium antimicrobial agent. Unless otherwise noted below, the composition of the present invention comprises from about 0.05% to about 15% by weight of a malodor controlling agent.

A Quaternary Ammonium Antimicrobial Agent

The quaternary ammonium antimicrobial agent useful herein typically kills microorganisms located on or inside of the fabric article and/or prevents microorganism growth. Such microorganisms, such as bacteria and fungi, may be a significant cause of malodor. While many types of antimicrobial agents are available, the antimicrobial agent useful herein should meet following requirements:

i) The antimicrobial agent should be safe, and typically should not cause any adverse reactions on human skin. Preferably the antimicrobial agent is also environmentally-friendly.
ii) The antimicrobial agent should be very effective at even low dosages, in case there is only a limited amount of deposition. The antimicrobial efficacy should include both bacteriocidal efficacy and bacteriostatic efficacy. The antimicrobial agent is preferably able to be deposited onto the fabric article surfaces (surfaces of yarn, and even better to penetrate into the yarn and deposit onto the surfaces of single fibers) by themselves or to be co-deposited with the softening agents. Normally, positively charged antimicrobial agents with high hydrophobicity will have a higher deposition efficiency.
iii) The antimicrobial agent's antimicrobial efficacy should be sustainable for a long time to provide a residual antimicrobial efficacy even with the interaction of fabrics which are normally negatively charged. It has been frequently observed that many strong antimicrobial agents lose or possess diminished antimicrobial efficacy upon interaction with negatively-charged surfaces.

The efficacy of the antimicrobial agent may be determined by measuring the bacteriocidal efficacy and bacteriostatic efficacy of the MIC/MBC in the solution. Bacteria-growth prevention efficacy may be measured by directly applying the antimicrobial agent to a fabric article's surface. Preferably, the efficacy of the antimicrobial agent is measured by treating fabrics (following consumer habits) with a fabric softener composition containing the antimicrobial agent.

The method/procedure to determine the antimicrobial prevention (bacteriostatic) efficacy was adopted and modified from the SEK method. This method is used by the Japanese Association of Fabric Evaluation Technology to qualify fabrics woven/treated with antimicrobial agents to make relevant claims.

The SEK method is as follows: Bacteria (*S. aureus* and/or *E. coli,* or *K. pneumonia,* respectively) are inoculated ($10^{3-4}$ cfu/swatch) onto three pieces of fabric swatches (around 10–15 $cm^2$, each). The swatches have either been washed in a rinse cycle with an antimicrobial fabric softening composition, or have had an antimicrobial agent applied thereto. The inoculated swatches are kept in a container and sealed to keep in moisture. After incubation under 35+/−2° C. for 18 hours, the fabrics are soaked in a neutralizer solution. The bacteria are then extracted from the fabrics with a sonicator. The solution which contains extracted bacteria are then serially diluted. Aliquots (1 ml) from each dilution are pour-plated onto agar medium. After incubation at 35+/−2° C. for 48 hours, the number of colonies on each plate are counted. The number of bacteria (cfu) on each swatch are then calculated. The number of bacteria grown on non-treated fabrics is used as control.

From extensive screening results, and without intending to be limited by theory, we believe that positively charged quaternary amines (either alkyl or ring-containing) with long hydrophobic side chains are especially useful as antimicrobial agents in the present invention. Without intending to be limite dby theory, it is believed that these antimicrobial agents are especially able to be co-deposited onto individual fabric fibers, along with the fabric softening active.

The general structure of this preferred quaternary ammonium antimicrobial agent is:

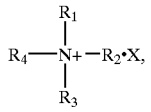

wherein $R_1$–$R_4$ are independently selected from $C_1$–$C_{22}$ alkyl groups, where X is a negatively charged group, which is preferably selected from the group consisting of halogen, acetic acid or other small negative ions. One of the $R_1$–$R_4$ group has a chain length longer than $C_{10}$. Preferably, $R_1$ and $R_2$ are both methyl, while $R_3$ and $R_4$ are long chain alkyl groups (e.g., $C_{10}$–$C_{18}$). More preferably, $R_1$ and $R_2$ are both methyl, and $R_3$ and $R_4$ are $C_{10}$ alkyl chains; this antimicrobial agent is known as didecyl dimethyl ammonium. Didecyl dimethyl ammonium chloride is available from Lonza Inc., Fair Law, N.J., USA, as BARDAC™. The formula for BARDAC™ is:

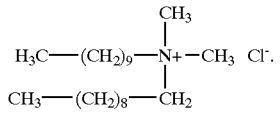

Another highly preferred quaternary ammonium antimicrobial agent useful herein is a benzalkonium ($R_1$ and $R_2$ are both methyl, $R_3$ is methylbenzyl and $R_4$ is —$(CH_2)_n$—$CH_3$, wherein n is 12–18), or a mixture thereof, such as benzalkonium chloride having the formula below. Preferably, n is from 12 to 18.

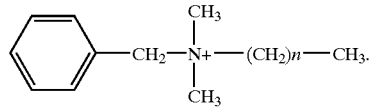

Cyclodextrin

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups.

The complexing between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels. As the water is being removed however, e.g., the fabric is being dried off, some low molecular weight organic amines and acids have more affinity and will complex with the cyclodextrins more readily.

Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Cyclodextrins that are especially useful in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio)propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydrocyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. Nos. 3,426,011; 3,453,257; 3,453,258; 3,453,259; 3,453,260; 3,459,731; 3,553,191; 3,565,887; 4,535,152; 4,616,008; 4,678,598; 4,638,058; and 4,746,734.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

Further, it is also preferable to use a less soluble cyclodextrin or mixture containing such a cyclodextrin to promote deposition of the cyclodextrin on the clothing in the rinse solution.

Adjunct Ingredients

The balance of the fabric softening composition is one or more adjunct ingredients, such as a pH-adjuster, a principal solvent extender, a polyoxyalkylene alkylamide surface active agent, a nonionic surfactant, a stabilizer, a low molecular weight water soluble solvent, a chelating agent, and a combination thereof.

Preferably a pH-adjuster is provided herein. For the preceding ester fabric softening agents, the pH is an important parameter, as it influences the stability of the fabric softening active, especially quaternary ammonium or amine precursors compounds, during prolonged storage conditions.

Examples of preferred pH-adjusters include a Bronsted acid, an inorganic mineral acid, a carboxylic acid, in particular the low molecular weight ($C_1$–$C_5$) carboxylic acids, and/or an alkylsulfonic acid. Suitable inorganic acids include HCl, $H_2SO_4$, $HNO_3$ and $H_3PO_4$. Suitable organic acids include formic, acetic, citric, methylsulfonic and ethylsulfonic acid. Preferred pH-adjusters useful herein include citric acid, hydrochloric acid, phosphoric acid, formic acid, methylsulfonic acid, benzoic acid, and a mixture thereof.

The composition herein is operable at pH of less than about 6.0, for optimum hydrolytic stability of these compositions, the pH is preferably from about 2.0 to about 5, more preferably from about 2.5 to about 4.5, and even more preferably from about 2.5 to about 3.5. The pH, as defined in the present context, is measured in the neat compositions at 20° C.

The principal solvent extender useful herein is especially useful in cases where the perfume of the fabric softening composition is less than about 1%, by weight. The principal solvent extender useful herein includes the principal solvent extender to enhance stability and clarity of the formulations and in certain instances provide increased softness benefits. The fabric softening composition typically contains from about 0.05% to about 10%, more preferably from about 0.5% to about 5% and most preferably from about 1% to about 4% principal solvent extender, by weight.

The principal solvent extender may include a range of materials with proviso that the material provide stability and clarity to a compositions having reduced principal solvent levels and typically reduced perfume or fragrance levels. Such materials typically include hydrophobic materials such a polar and non-polar oils, and more hydrophilic materials like hydrotropes and salts of groups IIB, III and IV of the periodic table in particular salts of groups IIB and IIIB such as aluminum, zinc, tin chloride salts, sodium EDTA, sodium DPTA, and other salts used as metal chelators.

The metallic salt herein is also useful in order to remove malodor on fabric. It is believed to aggregate amine-containing compounds and sulfur-containing compounds, which may cause malodor. Without intending to be limited by theory, it is believed that a metallic salt is especially useful in combination with the odor encapsulating active, as the metallic salt may aggregate small malodor molecules which are too small to be trapped by the odor encapsulating active.

Preferred metallic salts are water-soluble salts such as a copper salt, a zinc salt and a mixture thereof, especially those described in U.S. Pat. No. 5,783,544 to Trinh, et al., issued on Jul. 21, 1998 (columns 9–10). If present, the typical level of the metallic salts in the present invention is from about 0.05% to about 3%, preferably, from about 0.05% to about 1%, more preferably, from about 0.1% to about 0.3%, by weight.

Polar hydrophobic oils may be selected from emollients such as fatty esters, e.g. methyl oleates, derivatives of myristic acid such as isopropyl myristate, and triglycerides such as canola oil; free fatty acids such as those derived from canola oils, fatty alcohols such as oleyl alcohol, bulky esters such as benzyl benzoate and benzyl salicilate, diethyl or dibutyl phthalate; bulky alcohols or diols; and perfume oils particularly low-odor perfume oils such as linalool; mono or poly sorbitan esters; and mixtures thereof. Non-polar hydrophobic oils may be selected from petroleum derived oils such as hexane, decane, penta decane, dodecane, isopropyl citrate and perfume bulky oils such as limonene, and mixtures thereof. In particular, the free fatty acids such as partially hardened canola oil may provide increased softness benefits.

Particularly preferred hydrophobic oils include the polar hydrophobic oils. In particular, polar hydrophobic oils which have a freezing point, as defined by a 20% solution of the extender in 2,2,4-trimethyl-1,3-pentanediol, of less than about 22° C. and more preferably less than about 20° C. Preferred oils in this class include methyl oleate, benzyl benzoate and canola oil.

Suitable hydrotropes include but are not limited to aromatics, polycyclic aromatics (as defined in *Introduction to Organic Chemistry,* 2$^{nd}$ Ed., Andrew Streitwieser, Jr. And Clayton H. Heathcock, Macmillan Publishing Co., Inc.1981) substituted with one or more electronegative or ionic moieties (e.g. alcohols, amines, amides, carboxylic acid, carboxylates, sulfates, sulfonates, phosphates, phosphonates, phosphate esters, etc.) which may optionally be substituted with a one or more hydrocarbons, which are linear and/or branched, having less than or equal to about 10 carbons. Nonlimiting examples of such compounds include Etelsols® AX40, PT45, SC40, SC93 (Albright & Wilson), Burcofac® 6660K, Burlington Chem. Co., Inc. Additional suitable hydrotropes are compounds with one or more branched or linear hydrocarbon chains, preferably no more than about two chains, having less than or equal to about 14 carbons on each chain and substituted with one or more electronegative or ionic moieties, as described above. Non-limiting examples of these compounds include Alpha Step® ML40 (Stepan), Karasurf® AS-26 (Clark Chemical, Inc.), Monoteric® 1188M (Mona Industries), Ampholak® XJO (Berol Nobel AB), Glucopon® 225 (Henkel Corp./Emery Group). Suitable cationic counterions for anionic hydrotropes include, but are not limited to, groups IA and IIA of the periodic table and ammonium or ammonium compounds (e.g. iso-propyl ammonium, triethyl ammonium or triethanolammonium) and suitable anionic counterions for cationic hydrotropes may be chosen from, but are not limited to, the group of anions suitable for fabric softener actives (see below) especially sulfonate salts particularly alkali metal sulfonates and carboxylic acid derivatives such as isopropyl citrate. In particular, sodium and calcium cumene sulfonates, sodium and calcium xylene sulfones, and sodium and calcium toluene sulfonates. Alternative hydrotropes include benzoic acid and its derivatives, salts of benzoic acid and its derivatives. Diamine compounds may also be employed particularly those having the formula:

$$(R_1)(R_2)N(CX_2)_nN(R_3)(R_4),$$

wherein X is selected from the group consisting of hydrogen, linear or branched, substituted or unsubstituted alkyl having from 1–10 carbons atoms and substituted or unsubstituted aryl having at least 6 carbon atoms; n is an integer from 0 to 6; $R_1$, $R_2$, $R_3$, and $R_4$ are independently selected from the group consisting of hydrogen; alkyl; aryl; alkaryl; arylalkyl; hydroxyalkyl; polyhydroxyalkyl; polyalkylether having the formula $—((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: $—(O(CH_2)_y)_zR_7$; the group $—C(O)R_8$ where $R_8$ is alkyl; alkaryl; arylalkyl; hydroxyalkyl; polyhydroxyalkyl, polyalkylether, carboxylic acid, dicarboxylic acid, phosphonic acid and alkyl phosphonic acid as defined in $R_1$, $R_2$, $R_3$, and $R_4$; linear or branched carboxylic acid and water soluble salts thereof having the general formula $—(CH_p(R_7)_q)_t$ wherein t is an integer from 1 to 5, p+q=2; dicarboxylic acid and water soluble salts thereof; linear, branched or polyfunctional substituted branched alkyldicarboxylic acids and water soluble salts thereof; phosphonic acids and water soluble salts thereof, linear, branched or polyfunctional substituted branched alkylphosponic acids and water soluble salts thereof; and $CX_2CX_2N(R_5)(R_6)$ with no more than one of $R_1$, $R_2$, $R_3$, and $R_4$ being $CX_2CX_2N(R_5)(R_6)$ and wherein $R_5$ and $R_6$ are alkyl; alkaryl; arylalkyl; hydroxyalkyl; polyhydroxyalkyl, polyalkylether, alkoxy, polyalkoxy, carboxylic acid, dicarboxylic acid, phosphonic acid and alkyl phosphonic acid as defined in $R_1$, $R_2$, $R_3$, and $R_4$; and either of $R_1$+$R_3$ or $R_4$ or $R_2$+$R_3$ or $R_4$ can combine to form a cyclic substituent.

Preferred diamines include those where $R_1$, $R_2$, $R_3$, and $R_4$ are independently selected from the group consisting of hydrogen, alkyl groups having from 1 to 5 carbon atoms and hydroxyalkyl groups having from 1 to 5 carbon atoms, preferably ethyl, methyl, hydroxyethyl, hydroxypropyl and isohydroxypropyl.

Additional suitable hydrophilic materials useful herein as a principal solvent extender include metal chelators such as, but not limited to, ethylenediaminetetraacetate (EDTA), diethylenetriaminepentaacetate (DTPA), ethylene diamine-N,N'-disuccinate (EDDS), and/or citrate, both as neutral compounds or salts with cations especially, but not limited to, cations from Groups IA, IIA, VIA, VIIA, VIII, IB, and IIB of the periodic chart, for instance sodium EDTA, sodium DTPA, and calcium citrate; ammonium and ammonium are also suitable cations for anionic metal chelators. Salts can also be suitable as hydrophilic materials including, but not limited to salts of groups IIB, IIIB and IV of the periodic table, in particular, salts of groups IIB and IIIB such as aluminum, zinc, and tin chloride salts are also useful.

It should also be understood that a suitable principle solvent extender system may also be considered to comprise any combinations of all principle solvent extenders listed above.

The present invention may comprise from about 0%, preferably from about 0.5% to about 10%, preferably to about 0.5%, more preferably to about 4%, most preferably to about 3% by weight, of one or more polyoxyalkylene alkyl amide surface active agent.

The nonionic surfactants suitable for use in the present invention have the formula:

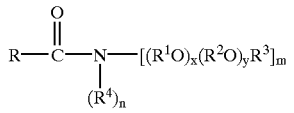

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof; $R^1$ is ethylene; $R^2$ is $C_3$–$C_4$ linear alkyl, $C_3$–$C_4$ branched alkyl, and mixtures thereof; preferably $R^2$ is 1,2-propylene. Nonionic surfactants which comprise a mixture of $R^1$ and $R^2$ units preferably comprise from about 4 to about 12 ethylene units in combination with from about 1 to about 4 1,2-propylene units. The units may be alternating, or grouped together in any combination suitable to the formulator. Preferably the ratio of $R^1$ units to $R^2$ units is from about 4:1 to about 8:1. Preferably a $R^2$ unit (i.e. 1,2-propylene) is attached to the nitrogen atom followed by the balance of the chain comprising from 4 to 8 ethylene units.

In the above formula, $R^3$ is hydrogen, $C_1$–$C_4$ linear alkyl, $C_3$–$C_4$ branched alkyl, and mixtures thereof; preferably hydrogen or methyl, more preferably hydrogen. $R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R^4$ unit is absent and is instead replaced by a $—[(R^1O)_x(R^2O)_yR^3]$ unit.

The index m is 1 or 2, the index n is 0 or 1, provided that when m is equal to 1, n is equal to 1; and when m is 2 n is 0; preferably m is equal to 1 and n is equal to one, resulting in one $—[(R^1O)_x(R^2O)_yR^3]$ unit and $R^4$ being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all of the alkyleneoxy units are ethyleneoxy units. Those skilled in the art of ethoxylated polyoxyalkylene alkyl amide surface active agents will recognized that the values for the indices x and y are average values and the true values may range over several values depending upon the process used to alkoxylate the amides.

Suitable means for preparing the polyoxyalkylene alkylamide surface active agents of the present invention can be found in "Surfactant Science Series", Editor Martin Schick, Volume I, Chapter 8 (1967) and Volume XIX, Chapter 1 (1987).

Suitable nonionic surfactants useful herein serve as the viscosity/dispersability modifiers include addition products of ethylene oxide and, optionally, propylene oxide, with fatty alcohols, fatty acids, fatty amines, etc. They are referred to herein as ethoxylated fatty alcohols, ethoxylated fatty acids, and ethoxylated fatty amines. Any of the alkoxylated materials of the particular type described hereinafter can be used as the nonionic surfactant. In general terms, the nonionics herein, when used alone, in liquid compositions are at a level of from 0% to 5%, preferably from 0.1% to 5%, more preferably from 0.2% to 3%.

A stabilizer is highly desirable herein, such as an antioxidant and/or a reductive agent. A stabilizer is present at from 0% to about 2.0%, preferably from about 0.001% to about 0.2%, more preferably from about 0.01% to about 0.1% for antioxidants, and more preferably from about 0.01% to about 0.2% for reductive agents. These may provide good odor stability under long term storage conditions. Antioxidants and reductive agent stabilizers are especially critical for unscented or low scent products (no or low perfume).

Examples of antioxidants that can be added to the dispersion compositions include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125 mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzene-sulfonic acid/sodium salt and DTPA.RTM., available from Aldrich with a chemical name of diethylenetriaminepentaacetic acid. For further examples of suitable stabilizers see U.S. Pat. No. 5,574,179 Wahl, et al., issued Feb. 28, 1995.

The low molecular weight water soluble solvent may be present at from about 0% to about 12%, preferably from about 1% to about 10%, more preferably from about 2% to about 8% by weight. Such solvents include: ethanol; isopropanol; propylene glycol; hexylene glycol, 1,2-propanediol; 1,3-propanediol; propylene carbonate; 1,4 cyclohexanedimethanol; etc. but do not include any of the principal solvents. These water soluble solvents have a greater affinity for water, in the presence of hydrophobic materials like the softener compound, than the principal solvents.

A pro-perfume herein is also useful in order to mask malodor on fabric.

A pro-perfume is defined as a perfume precursor that releases a desirable odor and/or perfume molecule through the breaking of a chemical bond. Typically to form a pro-perfume, a desired perfume raw material is chemically linked with a carrier, preferably a slightly volatile or a sparingly volatile carrier. The combination results in a less volatile and more hydrophobic pro-perfume which results in increased deposition onto the fabric article. The perfume is then released by breaking the bond between the perfume raw material and the carrier either through a change in pH (e.g., due to perspiration during wear), air moisture, heat, and/or sunlight during storage or line drying. Thus, malodor is effectively masked by the release of the perfume raw material.

Thus, a pro-perfume requires a perfume raw material. A perfume raw material is typically a saturated or unsaturated, volatile compound which contains an alcohol, an aldehyde, and/or a ketone group. The perfume raw material useful herein includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, hexyl cinnamic aldehyde; amyl cinnamic aldehyde; amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1-octanol; 2-methyl-3-(para-tert-butylphenyl)-propionaldehyde; 4-(4-hydroxy-4-methylpentyl)-3-cyclohexene-1-carboxaldehyde; tricyclodecenyl propionate; tricyclodecenyl acetate; anisaldehyde; 2-methyl-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil; lemon oil; grapefruit oil; bergamot oil; clove oil; dodecalactone gamma; methyl-2-(2-pentyl-3-oxo-cyclopentyl) acetate; beta-naphthol methyl-ether; methyl-beta-naphthylketone; coumarin; decylaldehyde; benzaldehyde; 4-tert-butylcyclohexyl acetate; alpha, alpha-dimethylphenethyl acetate; methylphenylcarbinyl acetate; Schiff's base of 4-(4-hydroxy-4-methylpentyl)-3-cyclohexene-1-carboxaldehyde and methyl anthranilate; cyclic ethyleneglycol diester of tridecandioic acid; 3,7-dimethyl-2,6-octadiene-1-nitrile; ionone gamma methyl; ionone alpha; ionone beta; petitgrain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; iso-hexenyl cyclohexyl carboxaldehyde; formyl tricyclodecan; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; ambroxane; dodecahydro-3a,6,6,9a-tetramethylnaphtho-[2,1b]furan; cedrol; 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; and condensation products of: hydroxycitronellal and methyl anthranilate; hydroxycitronellal and indol; phenyl acetaldehyde and indol; 4-(4-hydroxy-4-methyl pentyl)-3-cyclohexene-1-carboxaldehyde and methyl anthranilate.

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)-propanal; 2-methyl-3-(p-isopropylphenyl)-propanal; 3-(p-tert-butylphenyl)-propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionones; irones; cis-3-hexenol and esters thereof; indane musk fragrances; tetralin musk fragrances; isochroman musk fragrances; macrocyclic ketones; macrolactone musk fragrances; ethylene brassylate.

A preferred pro-perfume useful herein is described in columns 7–14 of U.S. Pat. No. 5,378,468 to Suffis, et al., issued on Jan. 3, 1995; and in U.S. Pat. No. 5,652,205 to Hartman, et al., issued on Jul. 29, 1997.

If present, the typical level of odor masking active is from about 0.05% to about 5%, preferably from about 0.1% to about 4%, more preferably from about 0.3% to about 3%, by weight.

Suitable solvents, diluents or carriers for the odor masking active herein include, for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

Hexylene glycol and/or ethanol are preferred co-solvents. Due to processing conditions, some of the I solvents which comprises the compositions of the present invention enter into the formulation by way of the softener active, for example, ethanol, hexylene glycol, and mixtures thereof can be used in preparing the preferred softener actives of the present invention and, therefore, are part of the fabric softening active raw material system.

One or more chelating agents such as copper and/or nickel chelating agents ("chelators"), for example, diethylenetriaminepentaacetic acid (DTPA) or ethylenediamine-N,N'-disuccinnic acid (EDDS) may be useful herein. The chelating agent may be added during the formation of the fabric softening active or the fabric softening composition. The chelating agent may be present in the composition in the range of from about 0.001% to about 10% by weight of the composition. More preferably the chelant is present in the range of from about 0.01% to about 5% and most preferably in the range of from about 0.01% to about 3% by weight of the composition.

Such water-soluble chelating agents can be selected from the group consisting of amino carboxylates, amino phosphonates, polyfunctionally-substituted aromatic chelating agents and mixtures thereof, all as hereinafter defined and all preferably in their acidic form. Amino carboxylates useful as chelating agents herein include ethylenediaminetetraacetic acid (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehex-acetates, diethylenetriaminepentaacetates (DTPA) and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in rinse-added fabric softener compositions, and include ethylenediaminetetrakis (methylenephosphonates), diethylenetriamine-N,N,N', N", N"-pentakis(methane phosphonate) (DTMP) and 1-hydroxyethane-1,1-diphosphonate (HEDP). Preferably, these amino phosphonates to not contain alkyl or alkenyl groups with more than about 6 carbon atoms. Preferred chelating agents useful herein include those described in U.S. Pat. No. 5,686,376 to Rusche, et al., issued Nov. 11, 1997 included herein by reference in its entirety.

Additional adjunct ingredients useful herein include a cationic charge booster, a perfume, a dispersability aid, a soil release agent, an enzyme, a dye transfer inhibiting agent, a scum dispersant, a suds suppresser, an optical brightener or other brightening or whitening agent, a dye fixing agent, a light fading protection agent, an oxygen bleach protection agent, a processing aid, a dye or a pigment, and a combination thereof. Examples of such useful adjunct ingredients are described in, for example, U.S. Pat. No. 5,747,443 to Wahl, et al., issued May 5, 1998, and in U.S. patent application Ser. Nos. 08/621,019; 08/620,627; 08/620,767; 08/620,513; 08/621,285; 08/621,299; 08/621,298; 08/620,626; 08/620,625; 08/620,772; 08/621,281; 08/620,514; and 08/620,958, all filed Mar. 22, 1996, and all having the title "CONCENTRATED, STABLE, PREFERABLY CLEAR, FABRIC SOFTENING COMPOSITION".

Examples of the invention are set forth hereinafter by way of illustration and are not intended to be in any way limiting of the invention.

EXAMPLE 1

The following clear liquid fabric softening compositions comprising an cyclodextrin agent may be formulated according to Table I.

TABLE I

| Ingredients | weight % 1 | 2 | 3 | 4 |
|---|---|---|---|---|
| Softener Active[1] | 26.0 | 26.0 | 30.0 | 26.0 |
| Fatty Acid[2] | 0.75 | 0.75 | — | 0.75 |
| TMPD[3] | 6.0 | 6.0 | 5.0 | — |
| Cocoamide[4] | 1.65 | 1.65 | — | — |
| $CaCl_2$ | 0.125 | 0.125 | — | — |

TABLE I-continued

| Ingredients | weight % 1 | 2 | 3 | 4 |
|---|---|---|---|---|
| $MgCl_2$ | — | — | 1.5 | 1.5 |
| HCl | 0.02 | 0.02 | — | 0.28 |
| NaHEDP[5] | 0.02 | 0.02 | — | 0.15 |
| Neodol 91-8[6] | — | — | 5.0 | 3.5 |
| BisDMAPA[7] | — | — | — | 0.50 |
| CHDM[8] | — | — | — | 2.5 |
| DTPA[9] | — | — | 0.02 | — |
| Hexyleneglycol | — | — | — | 2.5 |
| Perfume | 1.75 | 1.75 | 1.725 | 1.62 |
| Dye[10] | 0.001 | 0.001 | 0.001 | 0.001 |
| Cyclodextrin[11] | 1.0 | 0.3 | 0.1 | 0.3 |
| Demineralized water | Bal. | Bal. | Bal. | Bal. |

[1]Rewoquat V3620 - available from Goldschmidt
[2]Radiacid R0266 - available from Fina
[3]2,2,4-trimethyl-1,3-pentanediol - available from Eastman
[4]Rewopal C8P - available from Goldschmidt
[5]1-hydroxyethane-1,1-diphosphonate; Briquest ADPA-20AS - available from Albright & Wilson
[6]Available from Shell
[7]bis dimethylamino propylamine - available from BASF
[8]1,2-cyclohexanedimethanol
[9]diethylenetriaminepentaacetate; Versenex AD - available from Dow Chemical
[10]Milling Blue N-BL - available from Clariant Sandolan
[11]Methylated beta cyclodextrin - available from Wacker Cavasol W7MTL

EXAMPLE 2

The following clear liquid fabric softening compositions comprising a cyclodextrin, an odor masking active and antimicrobial formulated according to Table III.

TABLE II

| Ingredients | weight % 1 | 2 | 3 | 4 | 5 |
|---|---|---|---|---|---|
| Softener Active[1] | 28.0 | 28.0 | 28.0 | 28.0 | 28.0 |
| Hexyleneglycol | 2.47 | 2.47 | 2.47 | 2.47 | 2.47 |
| Ethanol | 2.47 | 2.47 | 2.47 | 2.47 | 2.47 |
| 2-Ethyl-1,3-hexandiol | 8.0 | 8.0 | 8.0 | 8.0 | 8.0 |
| HEDP[2] | 0.02 | 0.02 | 0.02 | 0.02 | 0.02 |
| Coco Amide | 1.65 | 1.65 | 1.65 | 1.65 | 1.65 |
| Perfume | 0.45 | 0.45 | 0.45 | 0.45 | 0.45 |
| $CaCl_2$ | 0.1 | 0.1 | 0.1 | 0.1 | 0.1 |
| HCl | 0.01 | 0.01 | 0.01 | 0.01 | 0.01 |
| Acid Blue 80 | 0.001 | 0.001 | 0.001 | 0.001 | 0.001 |
| Bardac/BKC | 1.0 | 2.5 | 3.0 | 4.5 | 5.0 |
| Benzyl Benzoate | 1.5 | 1.5 | 1.5 | 1.5 | 1.5 |
| Demineralized water | Bal. | Bal. | Bal. | Bal. | Bal. |

[1]N,N-di-(canolyl-oxy-ethyl)-N-methyl-N-(2-hydroxyethyl) ammonium methyl sulfate
[2]1-hydroxyethane-1,1-diphosphonate

EXAMPLE 3

The following clear liquid fabric softening compositions comprising an odor masking active formulated according to Table III.

TABLE III

| Ingredients | weight % 1 | 2 | 3 | 4 | 5 |
|---|---|---|---|---|---|
| Softener Active[1] | 28.0 | 28.0 | 28.0 | 28.0 | 28.0 |
| Hexyleneglycol | 2.47 | 2.47 | 2.47 | 2.47 | 2.47 |

TABLE III-continued

| Ingredients | weight % | | | | |
|---|---|---|---|---|---|
| | 1 | 2 | 3 | 4 | 5 |
| Ethanol | 2.47 | 2.47 | 2.47 | 2.47 | 2.47 |
| 2-Ethyl-1,3-hexandiol | 8.0 | 8.0 | 8.0 | 8.0 | 8.0 |
| HEDP[2] | 0.05 | 0.05 | 0.05 | 0.05 | 0.05 |
| Coco Amide | 1.65 | 1.65 | 1.65 | 1.65 | 1.65 |
| Perfume | 0.3 | 0.3 | 0.3 | 0.3 | 0.3 |
| $CaCl_2$ | 0.1 | 0.1 | 0.1 | 0.1 | 0.1 |
| HCl | 0.01 | 0.01 | 0.01 | 0.01 | 0.01 |
| Acid Blue 80 | 0.001 | 0.001 | 0.001 | 0.001 | 0.001 |
| Digeranyl succinate[3] | 0.25 | 0.35 | 0.5 | — | 0.25 |
| Linalyl (naphtoyl) acetate[3] | — | — | — | 0.3 | 0.25 |
| Demineralized water | Bal. | Bal. | Bal. | Bal. | Bal. |

[1]N,N-di-(canolyl-oxy-ethyl)-N-methyl-N-(2-hydroxyethyl) ammonium methyl sulfate
[2]1-hydroxyethane-1,1-diphosphonate
[3]a pro-perfume.

EXAMPLE 4

The following concentrated and dilute liquid fabric softening compositions comprising an odor masking active may be formulated according to Table IV.

TABLE IV

| Ingredients | weight % | |
|---|---|---|
| | 1 | 2 |
| Softener Active[1] | 17.61 | 5.2 |
| Silicone[2] | 0.01 | 0.004 |
| NaHEDP[3] | 0.17 | — |
| HCl | 0.005 | 0.013 |
| SRP[4] | 0.05 | — |
| $CaCl_2$ | 0.035 | — |
| PEG-4K[5] | 0.50 | — |
| GDA[6] | — | 0.025 |
| Perfume | 0.80 | 0.32 |
| Dye | 0.003 | 0.0006 |
| Cyclodextrin[7] | 1.0 | 1.0 |
| Demineralized water | Bal. | Bal. |

[1]Rewoquat V3682 - available from Goldschmidt
[2]Antifoaming agent: MP10 - available from Dow Corning
[3]1-hydroxyethane-1,1-diphosphonate; Briquest ADPA-20AS - available from Albright & Wilson
[4]Texcare 3639 - available from Clariant
[5]Stabilizer: Pluriol E4050E
[6]Preservative: gluteraldehyde 50% - available from BASF
[7]Methylated beta cyclodextrin - available from Wacher Cavasol W7MTL

Methods of Use

The present invention also provides a method for reducing and inhibiting the expression of malodors in fabric articles. The method comprises the steps of applying a fabric softening composition of the present invention as described hereinabove to a fabric article and drying the fabric article. The composition is preferably applied to the fabric article(s) during the laundry cycle, more preferably during a portion of the cycle after the fabric article has been washed with detergent and even more preferably during the rinse cycle portion of the process. Fabric softening compositions are typically dispensed in a rinse bath solution and the washed fabrics are immersed in the solution to enable thorough deposition of the fabric softening active on the fabrics.

A similar procedure may be used with the fabric softening compositions of the present invention to achieve an effective deposition of the malodor control agent as well. Dispensing of the compositions into the rinse bath solution may be achieved by placing the composition in a "built-in" dispenser of an automatic or semi-automatic washing machine, in a device that is added during the wash cycle and which releases the composition during the rinse cycle, or more simply, may be dispensed by hand during the rinse cycle.

The deposition of the malodor control agent along with the fabric softening active enables the agent to absorb malodors that may tend to form or deposit on the fabric subsequent to the laundering process, e.g. during storage and/or during wear, thereby inhibiting and or reducing the expression and detection of such malodors. Therefore, the present invention also provides for the use of a fabric softening composition as described hereinabove to reduce and inhibit the expression of malodors in a fabric article by applying the composition to the fabric article during the laundering process.

Article of Manufacture

The present invention further still provides an article for reducing and inhibiting the expression of malodors in a fabric article. The article comprises a fabric softening composition as described hereinabove and a set of instructions associated with the composition. The set of instructions includes an instruction for using said fabric softening composition to reduce and inhibit the expression of malodors in a fabric article. The set of instructions may also relate to various methods for applying the composition to fabric articles.

The set of instructions may be placed upon the container or packaging for the fabric softening composition or may be published in association with advertisements concerning the fabric softening composition and thus may appear in a variety of media. It is preferred that the fabric softening composition be provided in a container or package that bears the instructions concerning the use of the product to reduce and inhibit the expression or malodors in fabrics.

Testing Procedures

Several of the above detailed formulations with and without cyclodextrin were used to test the effects of cyclodextrin on perfume intensity and malodor expression.

Perfume Intensity Test

It is not uncommon for consumers to forget to remove damp articles from the washing machine after the wash cycle is complete. These articles are commonly left in the washing machine overnight or for one or more days where malodors are generated saturating the articles giving them an unpleasant "sour" odor. The removal of these malodors generally requires one or more repeat washings.

The formula set forth above in Table III under column 3, was used to prepare two solutions of fabric softener, a first without cyclodextrin and a second with the 1% amount of cyclodextrin recited in column 3. Respective loads of similar fabric articles were washed and rinsed in the two softener solutions. The articles were not dried but were allowed to remain in the washing machines for 24 hours. The articles were removed from the machines and graded according to the perfume intensity detected. The grading was based on a scale of 1–100, wherein 1 represents the detection of a minimum amount of perfume and 100 represents the detection of a very strong perfume odor. An average of two testing runs yielded the following results:

| Perfume Intensity Following Wet Storage | |
|---|---|
| Composition | Grade |
| Composition without cyclodextrin | 53 |
| Composition with cyclodextrin | 73 |

The formula set forth above in Table IV at column 1 was used to prepare two solutions of fabric softener, a first without cyclodextrin and a second with the 1% amount of cyclodextrin recited in column 1. Again, respective loads of articles were washed and rinsed with the respective fabric softeners and allowed to remain in the machine for 24 hours. The articles were tumbled dry and then graded on a scale of 1–100 for their perfume intensity. An average of two testing runs yielded to the following results:

| Perfume Intensity Following Wet Storage/Tumble Drying | |
|---|---|
| Composition | Grade |
| Composition without cyclodextrin | 44 |
| Composition with cyclodextrin | 48 |

Smoke Exposure Test

A smoke exposure test was conducted on new terry cloth towels that had been subjected to 4 wash/dry laundering cycles. Fabric softening solutions were made in accordance with the formulations found in Table III in columns 1 and 2, containing 1% and 0.3% cyclodextrin by weight, respectively. The towels were washed again and treated with the respective fabric softening compositions.

A cigarette was allowed to burn for 2 minutes inside of a closed 200 liter drum. The cigarette was removed and the towels were hung in the chamber for a predetermined amount of time. The towels were then removed and graded for "freshness retention." Freshness retention is a measure of the perfume intensity relative to the malodor intensity such that a high number reflects more detectable perfume than malodor. A reference article bearing no perfume or detectable malodor was indexed at 100. Two runs of this procedure yielded the following average results:

| Smoke Exposure - Freshness Retention | |
|---|---|
| Composition | Grade (Ref. 100) |
| Composition with cyclodextrin (1%) | 170 |
| Composition with cyclodextrin (0.3%) | 123 |

Artificial Body Odor Test

An artificial body odor test was conducted on new items of clothing that had been subjected to repeated wash/dry cycles. The articles were then washed again and treated with one of the two rinse added fabric softeners. The two fabric softeners tested were prepared according to the formula set forth above in Table III in column 1, a first with and a second without the 1% cyclodextrin recited therein. 80 ml of an artificial body odor solution was applied to the clothing items by applying the solution to a 2"×2" square area. The solution was applied uniformly in 8 rows of 10 ml each. The clothing items were allowed to dry and equilibrate overnight at ambient temperature in sealed plastic bags. The clothing items were then graded for freshness retention as discussed above.

| Artificial Body Odor - Freshness Retention | |
|---|---|
| Composition | Grade (Ref. 100) |
| Composition without cyclodextrin | 100 |
| Composition with cyclodextrin | 222 |

What is claimed is:

1. A fabric softening composition for preventing and/or inhibiting the expression of malodor, the composition comprising;

from about 1% to about 90%, by weight of a fabric softening active selected from the group consisting of

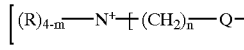

wherein each R is independently selected from the group consisting of a $C_1$–$C_6$ alkyl, a $C_1$–$C_6$ hydroxyalkyl, and benzyl; each $R^1$ is independently selected from the group consisting of a $C_{11}$–$C_{22}$ linear alkyl, a $C_{11}$–$C_{22}$ branched alkyl, a $C_{11}$–$C_{22}$ linear alkenyl, and a $C_{11}$–$C_{22}$ branched alkenyl; each Q is independently a carbonyl moiety having the formula:

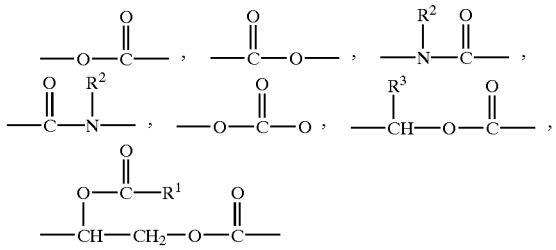

wherein each $R^2$ is independently selected from the group consisting of hydrogen, a $C_1$–$C_4$ alkyl, and a $C_1$–$C_4$ hydroxyalkyl; each $R^3$ is independently selected from the group consisting of hydrogen and a $C_1$–$C_4$ alkyl; $X^-$ is a softener compatible anion; m is from 1 to 3; n is from 1 to 4 and

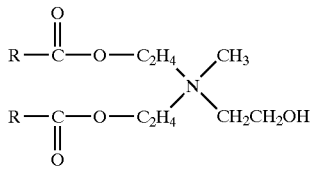

wherein each R is independently a $C_{14}$–$C_{20}$ alkyl chain; and from about 0.01% to about 20%, by weight of a malodor control agent comprising an uncomplexed cyclodextrin.

2. The composition of claim 1, wherein the malodor control agent further comprises an anti-microbial agent.

3. The composition of claim 1, wherein the fabric softening active has a Hunter "L" transmission of at least about 85.

4. The composition of claim 1, wherein each Q has the formula:

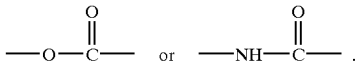

5. A composition of claim 1, wherein each R is independently selected from the group consisting of methyl and hydroxyethyl.

6. The composition of claim 1, wherein the fabric softener active is at least about 5.5% of the composition.

7. The composition of claim 1, further comprising from about 1% to about 25% by weight of a principal solvent having a ClogP of from about 0 to about 3.

8. The composition according to claim 7, wherein the principal solvent is selected from the group consisting of a mono-alcohol, a $C_6$ diol, a $C_7$ diol, octanediol, a butanediol derivative, trimethylpentanediol, ethylmethylpentanediol, propylpentanediol, dimethylhexanediol, ethylhexanediol, methylheptanediol, octanediol, nonanediol, an alkyl glyceryl ether, a di(hydroxy alkyl) ether, an aryl glyceryl ether, an alicyclic diol derivative, an alkoxylated $C_3$–$C_7$ diol derivative, an aryl diol, and mixtures thereof.

9. The composition of claim 8, wherein the principal solvent is selected from the group consisting of 1,2-hexanediol, 1,2-pentanediol, hexylene glycol, 1,2-butanediol, 1,4-cyclohexanediol, pinacol, 1,5-hexanediol, 1,6-hexanediol, and 2,4-dimethyl-2,4-pentanediol.

10. The composition according to claim 7, wherein the principal solvent has a Clog P of from about 0.15 to about 1.

11. The composition of claim 1, further comprising from about 0.1% to about 10% by weight of an electrolyte.

12. The composition of claim 1, further comprising from about 0.1% to about 15% by weight of a phase stabilizer.

13. The composition of claim 1, further comprising at least one pro-perfume component.

14. The composition of claim 1, further comprising from 0.1% to about 10% by weight of a principal solvent extender.

15. A method for reducing and inhibiting the expression of malodors in a fabric article comprising the steps of:

providing a fabric softening composition according to claim 1;

applying the fabric softening composition to a fabric article; and drying the fabric article.

16. An article for reducing and inhibiting the expression of malodors in a fabric article, the article comprising:

a composition according to claim 1, a set of instructions associated with the composition, said set of instructions comprising an instruction for using said composition to reduce and inhibit the expression of malodors in a fabric article.

* * * * *